US010485722B2

(12) United States Patent
Krinsky

(10) Patent No.: US 10,485,722 B2
(45) **Date of Patent: *Nov. 26, 2019**

(54) REINFORCED CORE CARDBOARD CASKET

(71) Applicant: Lynn Krinsky, Seattle, WA (US)

(72) Inventor: Lynn Krinsky, Seattle, WA (US)

( * ) Notice: Subject to any disclaimer, the term of this patent is extended or adjusted under 35 U.S.C. 154(b) by 121 days.

This patent is subject to a terminal disclaimer.

(21) Appl. No.: 15/708,078

(22) Filed: Sep. 18, 2017

(65) Prior Publication Data

US 2018/0064596 A1 Mar. 8, 2018

Related U.S. Application Data

(63) Continuation of application No. 15/184,155, filed on Jun. 16, 2016, now Pat. No. 9,763,844.
(Continued)

(51) Int. Cl.

| | |
|---|---|
| ***A61G 17/007*** | (2006.01) |
| ***A61G 17/02*** | (2006.01) |
| ***A61G 17/04*** | (2006.01) |
| *B31B 50/81* | (2017.01) |
| *B31B 105/00* | (2017.01) |

(Continued)

(52) U.S. Cl.
CPC ..... *A61G 17/0073* (2013.01); *A61G 17/02* (2013.01); *A61G 17/034* (2017.05); *A61G 17/04* (2013.01); *A61G 17/041* (2016.11); *B31B 50/81* (2017.08); *B31B 50/87* (2017.08);
(Continued)

(58) Field of Classification Search
CPC .. A61G 17/0073; A61G 17/007; A61G 17/02; A61G 17/04; A61G 17/041; A61G 17/004; A61G 17/034; B31B 2105/00; B31B 2110/35; B31B 50/81; B31B 50/87; B31B 2120/10; B31B 2120/502; B65D 5/46056; B65D 5/62; B65D 5/64; B65D 5/18; B65D 5/3685
USPC ..... 27/2, 4, 19, 27; 229/117.09, 125.01, 229/185.1; 493/53, 56, 59, 160
See application file for complete search history.

(56) References Cited

U.S. PATENT DOCUMENTS

| | | |
|---|---|---|
| 3,969,798 A | 7/1976 | Sahlin |
| 4,146,948 A | 4/1979 | Royce et al. |

(Continued)

FOREIGN PATENT DOCUMENTS

| | | |
|---|---|---|
| CN | 2436141 Y | 6/2001 |
| CN | 201959178 U | 9/2011 |
| DE | 10034047 A1 | 1/2002 |

*Primary Examiner* — William L Miller
(74) *Attorney, Agent, or Firm* — Christensen O'Connor Johnson Kindness PLLC

(57) ABSTRACT

A cardboard casket includes a top piece and a bottom piece. The top piece is formed by making a single press die cut in a reinforced core cardboard panel, including cutting the reinforced core cardboard panel to form the top piece and forming seams in the top piece. The bottom piece is formed by making another single press die cut in another reinforced core cardboard panel, including cutting the other reinforced core cardboard panel to form the bottom piece and forming seams in the bottom piece. Cutting the top and bottom pieces includes cutting through a first layer, a reinforced core, and a second layer of the reinforced core cardboard panels. Forming seams in the top and bottom pieces includes deforming the first layer in the seams, deforming a majority of the reinforced core in the seams, and leaving the second layer in the seam uncut.

19 Claims, 30 Drawing Sheets

Related U.S. Application Data

(60) Provisional application No. 62/181,098, filed on Jun. 17, 2015.

(51) Int. Cl.
*B31B 120/10* (2017.01)
*B31B 50/86* (2017.01)
*B31B 110/35* (2017.01)
*B31B 120/00* (2017.01)

(52) U.S. Cl.
CPC ..... *B31B 2105/00* (2017.08); *B31B 2110/35* (2017.08); *B31B 2120/10* (2017.08); *B31B 2120/502* (2017.08)

(56) References Cited

U.S. PATENT DOCUMENTS 5,035,032 A 7/1991 Nuttiing
5,307,545 A 5/1994 Stoltz
5,454,141 A 10/1995 Ozbun et al.
5,685,937 A 11/1997 Tambussi
5,770,291 A 6/1998 Tambussi
5,771,549 A 6/1998 Saaf
5,862,847 A 1/1999 Jenkins
5,960,978 A 10/1999 Jenkins
5,974,640 A 11/1999 Vosahlik et al.
6,131,253 A 10/2000 Jenkins
6,238,327 B1 5/2001 Tambussi
6,615,464 B2 9/2003 Tambussi
6,694,579 B2 2/2004 Belanger et al.
8,776,333 B2 7/2014 Van Den Bogart
3,056,197 A1 11/2015 Kemmerer
2012/0060334 A1 3/2012 Gesell et al.
2013/0074298 A1 3/2013 Mong
2014/0352120 A1 12/2014 Hui
2018/0177661 A1* 6/2018 Sundblad ..... A61G 17/007

* cited by examiner

REINFORCED CORE CARDBOARD CASKET

CROSS-REFERENCES TO RELATED APPLICATIONS

This application is a continuation of U.S. patent application Ser. No. 15/184,155, filed Jun. 16, 2016, which claims the benefit of U.S. Provisional Application No. 62/181,098, filed Jun. 17, 2015, the disclosures of which are incorporated by reference herein in its entirety.

BACKGROUND

Human remains are frequently contained in caskets prior to burial, entombment, or cremation. Traditional materials for caskets include various types of wood, such as oak, pine, and bamboo, various metal materials, such as steel and aluminum, and other structural materials, such as fiberglass or other composite materials. Traditional materials ensure that structural integrity of the casket while providing a dignified container for human remains. One benefit to these materials is that caskets can be used during memorial services and funerals to commemorate the dead in a dignified manner.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a method of forming pieces of a cardboard casket includes forming a top piece of a cardboard casket, forming a bottom piece of the cardboard casket, and printing, on an outer surface of the second layer of the top piece, one or more of text, graphics, or a background image. Forming the top piece includes making a first single press die cut in a first reinforced core cardboard panel. Making the first single cut die press includes cutting the first reinforced core cardboard panel to form the top piece and forming seams in the top piece. Forming the bottom piece includes making a second single press die cut in a second reinforced core cardboard panel. Making the second single cut die press includes cutting the second reinforced core cardboard panel to form the bottom piece and forming seams in the bottom piece. Each of the first and second reinforced core cardboard panels includes a first layer, a second layer, and a reinforced core located between the first and second layers. Cutting each of the top and bottom pieces includes cutting through the first layer, the reinforced core, and the second layer of one of the first and second reinforced core cardboard panels. Forming seams in each of the top and bottom pieces includes deforming the first layer in the seams, deforming a majority of the reinforced core in the seams, and leaving the second layer in the seam uncut.

In one example, the method further includes receiving a request for customized printing on the top piece. In another example, the request for customized printing on the top piece includes one or more of an image or text for printing on the top piece.

In one example, the reinforced core of each of the first and second reinforced core cardboard panels includes cells of a geometric shape. In another example, the geometric shape of the cells is a hexagon.

In one example, forming the top piece further includes placing adhesive on an outer surface of the second layer of a tab of the top panel. In another example, forming the top piece further includes folding the top piece along the seams of the top piece such that the adhesive on the tab adheres to the first layer of a side panel of the top piece.

In one example, making the first single cut die press further includes cutting a reinforcement piece from the first reinforced core cardboard panel. In another example, making the first single cut die press further includes cutting a pair of handle holes in the reinforcement piece. In another example, making the second single cut die press includes cutting a pair of handle holes in a side panel of the bottom piece. In another example, placing the reinforcement piece against the side panel of the bottom piece with the pair of handle holes in the reinforcement piece aligned with the pairs of handle holes in the side panel. In another example, the method further includes feeding ends of a handle through the aligned pair of handle holes in the reinforcement pieces and the pair of handle holes in the side panels and tying a knot in each of the ends of the handle to prevent the ends of the handle from being pulled back through the pair of handle holes in the reinforcement pieces and the pair of handle holes in the side panels.

In one example, an outer surface of the second layer of the bottom piece is printed before making the second single press die cut.

In one example, the seams in the bottom piece include a seam between a main panel and a side panel and a pair of seams between the side panel and a ledge panel. In another example, forming the bottom piece further includes folding the bottom piece along the seam between the main panel and the side panel to form an angle between the main panel and the side panel, folding the bottom piece along the pair of seams between the side panel and the ledge panel such that the first layer of the side panel is substantially parallel to the first layer of the ledge panel, and adhering the first layer of the side panel to the first layer of the ledge panel.

In one example, the seams in the bottom piece include a seam between a main panel and an end panel. In another example, forming the bottom piece further includes folding the bottom piece along the seam between the main panel and the end panel to form an angle between the main panel and the end panel, and adhering the end panel to two tabs of the bottom piece. In another example, the method further includes adhering an extension piece to the two tabs of the bottom piece above the end piece. In another example, making the first single cut die press further includes cutting the extension piece from the first reinforced core cardboard panel.

In another embodiment, a cardboard casket includes a bottom piece and a top piece. The bottom piece and the top piece are produced from a method that includes forming the top piece by making a first single press die cut in a first reinforced core cardboard panel and forming the bottom piece by making a second single press die cut in a second reinforced core cardboard panel. Making the first single cut die press includes cutting the first reinforced core cardboard panel to form the top piece and forming seams in the top piece. Making the second single cut die press includes cutting the second reinforced core cardboard panel to form the bottom piece and forming seams in the bottom piece. Each of the first and second reinforced core cardboard panels includes a first layer, a second layer, and a reinforced core located between the first and second layers. Cutting each of the top and bottom pieces includes cutting through the first layer, the reinforced core, and the second layer of one of the first and second reinforced core cardboard panels. Forming seams in each of the top and bottom pieces includes deforming the first layer in the seams, deforming a majority of the reinforced core in the seams, and leaving the second layer in the seam uncut.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Cardboard is an alternative material used to make caskets. Cardboard caskets have a number of advantages over traditional casket materials. One advantage is that cardboard materials are typically less expensive than traditional materials, such as wood, metal, or composite materials. The lower cost of cardboard materials reduces the overall cost of cardboard caskets compared to traditional caskets. Another advantage is that cardboard materials typically weigh less than traditional materials. The lower weight of cardboard materials reduces the overall weight of cardboard caskets compared to traditional caskets. Another advantage of cardboard caskets is that they are customizable. Text and graphics (e.g., pictures or other images) can be printed on a cardboard casket to customize them for the particular individual whose remains it holds. Customization of cardboard caskets is discussed in greater detail below.

Other benefits of cardboard caskets relate to the different ways in which they can be used. In the case of human remains that are to be cremated, the remains can be left in the cardboard casket during the cremation process. This allows a cardboard casket to be used to hold human remains prior to cremation (e.g., during a memorial service or funeral) and then the cremation process can be performed without removing the human remains from the cardboard casket. In one example, the cost of the cardboard casket is less than the cost of renting a traditional casket for use during a memorial service or funeral. In the case of human remains that are to be buried or entombed, cardboard caskets have the benefit of being biodegradable. Because cardboard caskets are biodegradable, they are less harmful for the environment and decompose naturally as the human remains inside them decompose. Cardboard caskets offer additional benefits beyond those mentioned here.

While cardboard caskets offer a number of benefits, many consumers perceive a deficiency in the structural integrity of cardboard caskets. Consumers are less likely to buy cardboard caskets if they perceive cardboard caskets to be structurally deficient. As described in greater detail below, reinforced core cardboard can provide the structural integrity required for cardboard caskets. In addition, a single-press die cut process can cut and create seams in reinforced core cardboard that allow the reinforced core cardboard to be folded into the proper shape of either a bottom piece or a top piece of a cardboard casket. Various embodiments of reinforced core cardboard caskets and pieces thereof are described herein.

Figure 1:
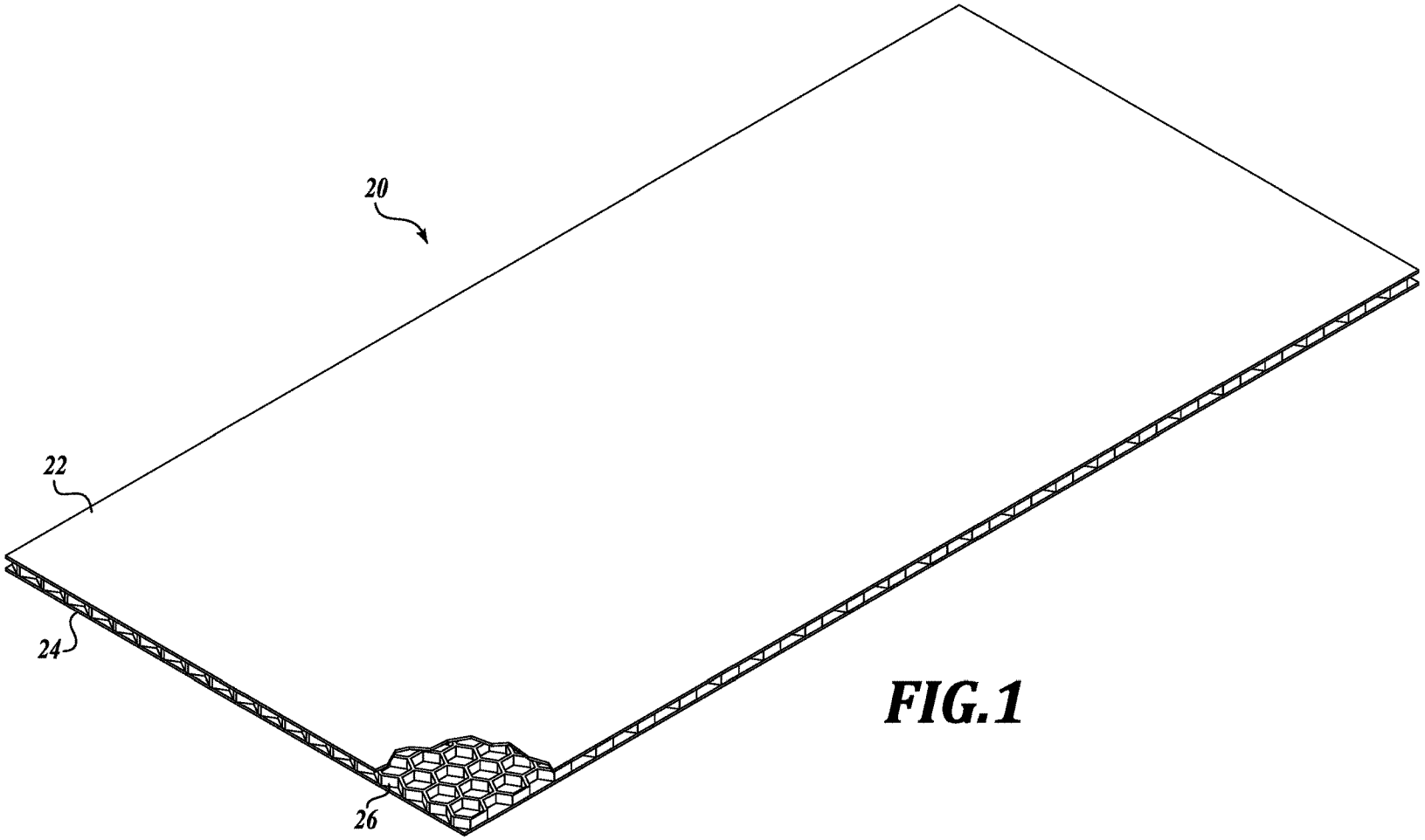
FIG. 1 depicts an embodiment of reinforced core cardboard usable in the embodiments of cardboard caskets described herein.

One embodiment of reinforced core cardboard usable in the embodiments of cardboard caskets is depicted in FIG. 1. More specifically, a panel 20 of reinforced core cardboard is depicted. The panel 20 includes a first layer 22 and a second layer 24. In some embodiments, the first and second layers 22 and 24 are made from kraft lineboard. In one example, the kraft lineboard of the first and second layers 22 and 24 has a rating in a range from about 26# kraft lineboard to about 90# kraft lineboard. In other embodiments, the first and second layers 22 and 24 are made from one or more materials, such as cellulose material, cardboard, plastic, plastic coated material, and the like. In some embodiments, the first and second layers 22 and 24 are made from recycled materials.

The panel 20 also includes a reinforced core 26 located between the first and second layers 22 and 24. The reinforced core 26 is configured to withstand a particular pressure without deforming. In one example, the core 26 is configured to withstand a particular pressure in a range from about 11 pounds per square inch (psi) to about 60 psi. In one embodiment, as depicted in FIG. 1B, the reinforced core 26 forms cells of geometric shapes. In the particular embodiment shown in FIG. 1B, the reinforced core 26 forms hexagonally-shaped cells. In one example, the cells of geometric shapes provide some or all of the structural rigidity that permits the reinforced core 26 to withstand a particular pressure without deforming.

The panel 20 can have particular dimensions. In some embodiments, the thickness of the panel 20 (i.e., the distance from the outer surface of the first layer 20 to the outer surface of the second layer 22) is in a range from about 0.375 inches to about 4.0 inches. In another embodiment, the panel 20 is formed with a particular length and a particular width. In some examples, the length is less than or equal to about 120 inches. In other examples, the width is less than or equal to about 60 inches. In yet other examples, the panel 20 is sold at a standard length of about 96 inches (i.e., 8 feet) and a standard width of about 48 inches (i.e., 4 feet).

Various pieces of cardboard coffins can be formed from panels of reinforced core cardboard, such as the panel 20 depicted in FIG. 1. One embodiment of a top piece 100 of a cardboard coffin formed from a panel of reinforced core cardboard is depicted, in various views, in FIGS. 2, 3, 4A, 4B, 4C, 5, 6A, and 6B. One embodiment of a bottom piece 200 of a cardboard coffin formed from a panel of reinforced core cardboard is depicted, in various views, in FIGS. 7, 8A, 8B, 9A, 9B, 10A, and 10B. Each of these embodiments is discussed below.

Figure 2:
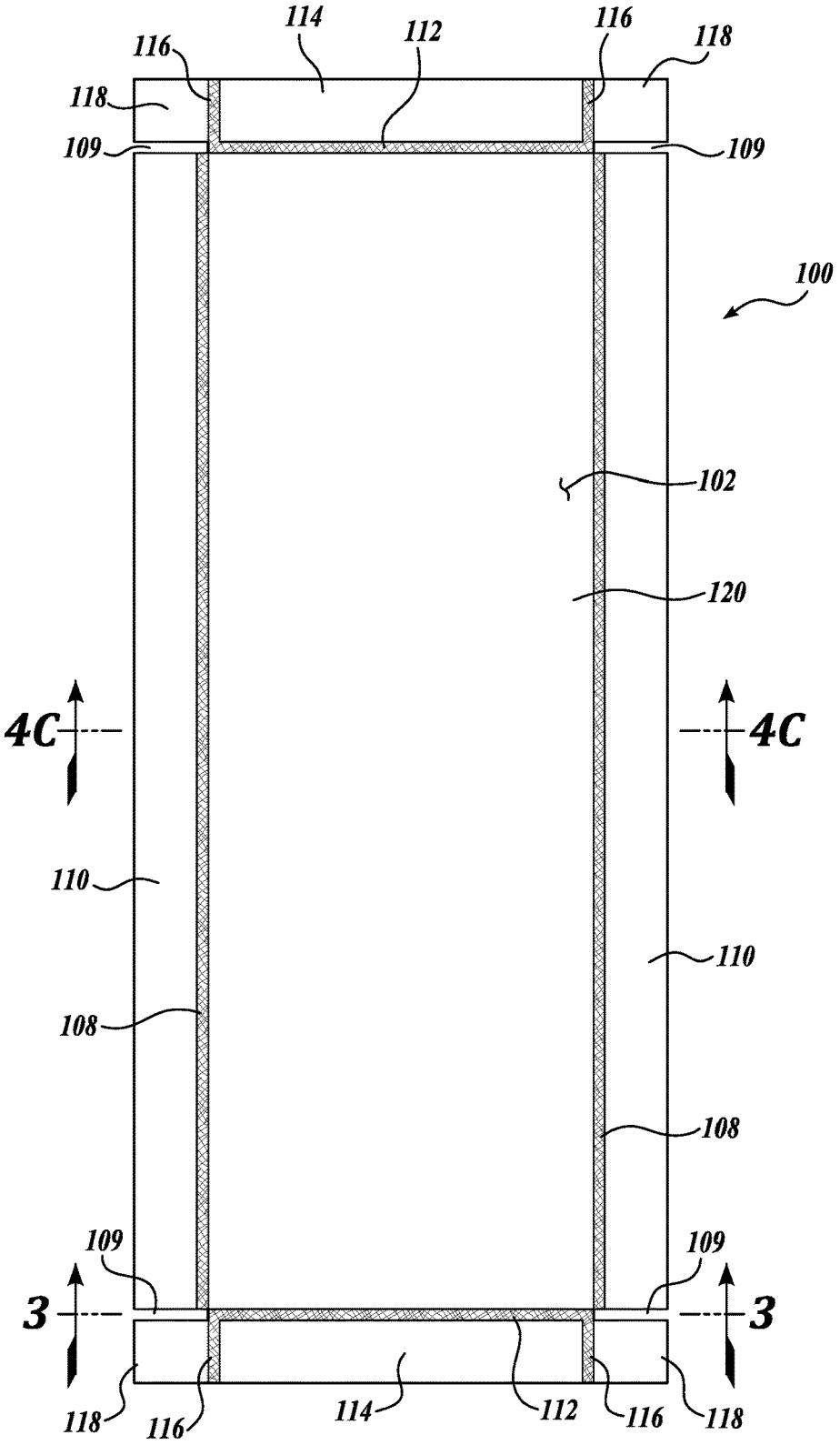
FIGS. 2 and 3 depict, respectively, a view of one side of an embodiment of a top piece and a partial cross-sectional side view of the top piece, in accordance with the embodiments disclosed herein.
Figure 3:
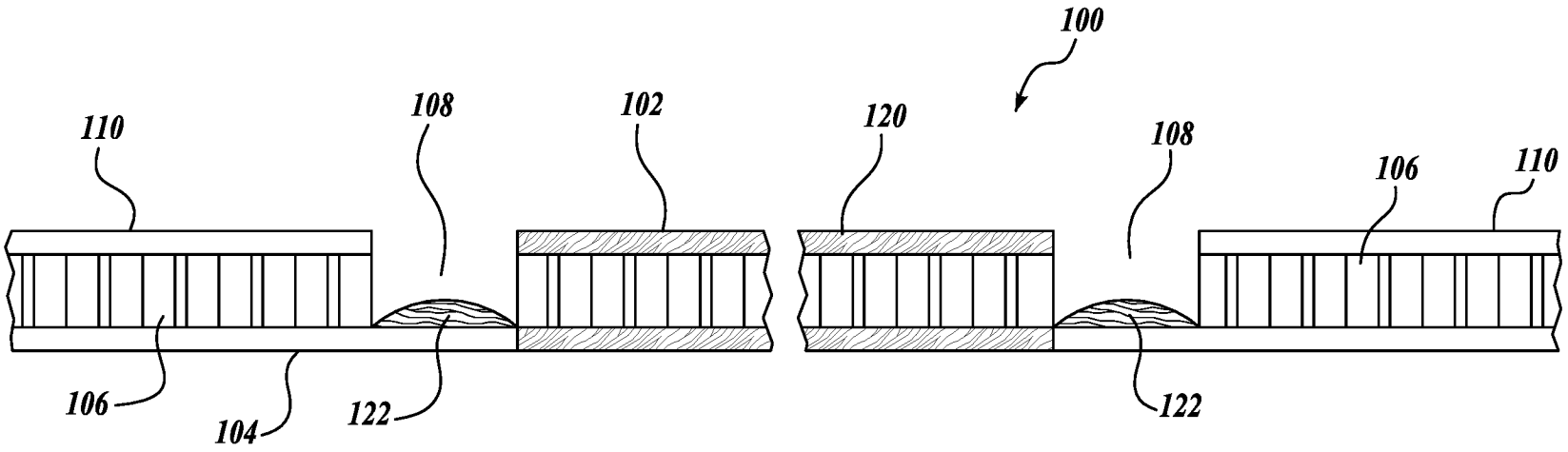

FIGS. 2 and 3 depict, respectively, a view of one side of the top piece 100 and a partial cross-sectional side view of the top piece 100. The top piece 100 is formed from reinforced core cardboard having a first layer 102, a second layer 104, and a reinforced core 106 between the first and second layers 102 and 104. In some embodiments, the first layer 102, the second layer 104, and the reinforced core 106 have characteristics similar to the first layer 22, the second layer 24, and the reinforced core 26 described above with respect to FIG. 1.

Figure 4A:
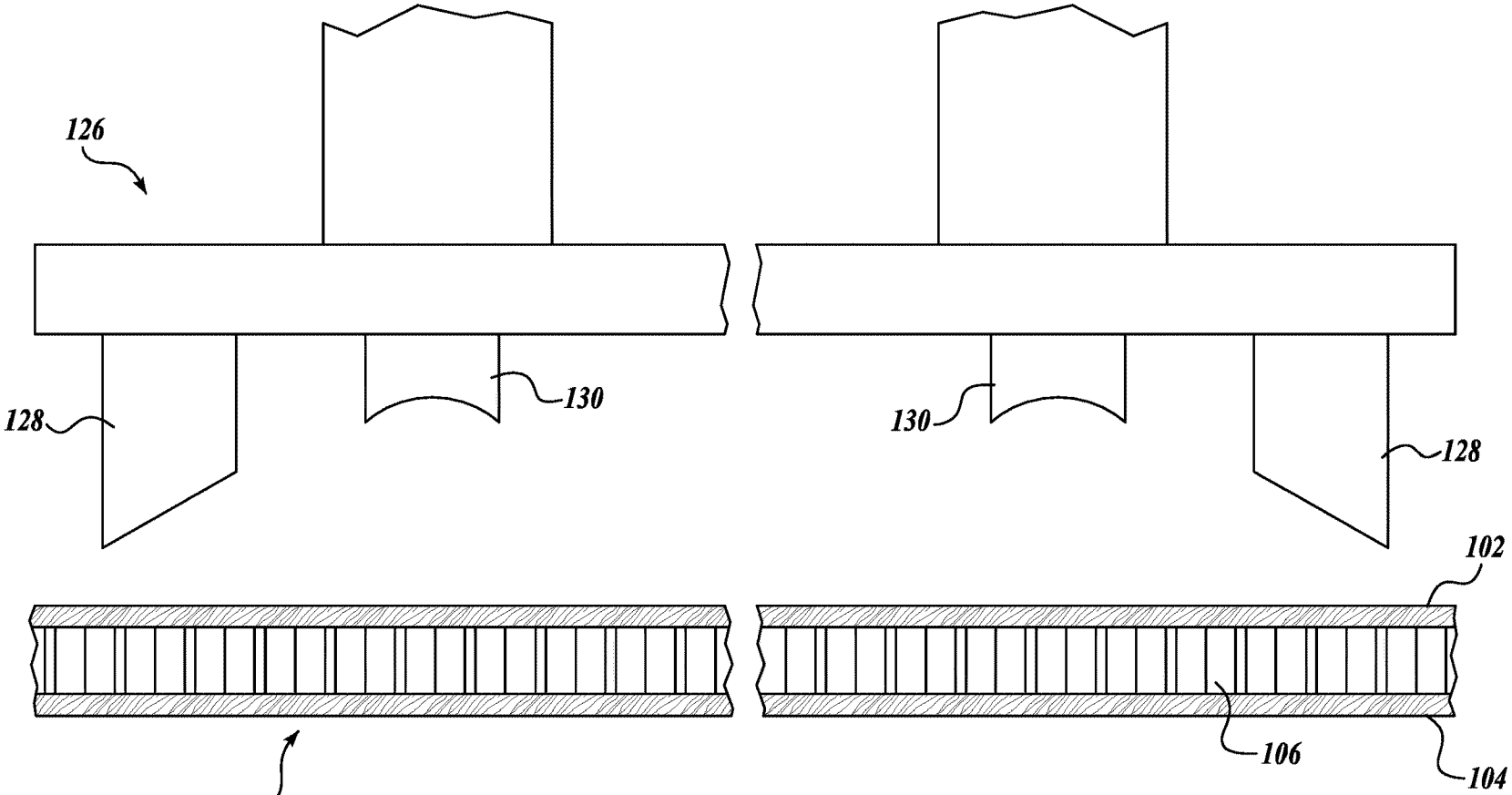
FIGS. 4A to 4C depict cross-sectional views of an embodiment of a single press die cut to create the top piece depicted in FIGS. 2 and 3, in accordance with the embodiments disclosed herein.
Figure 4B:
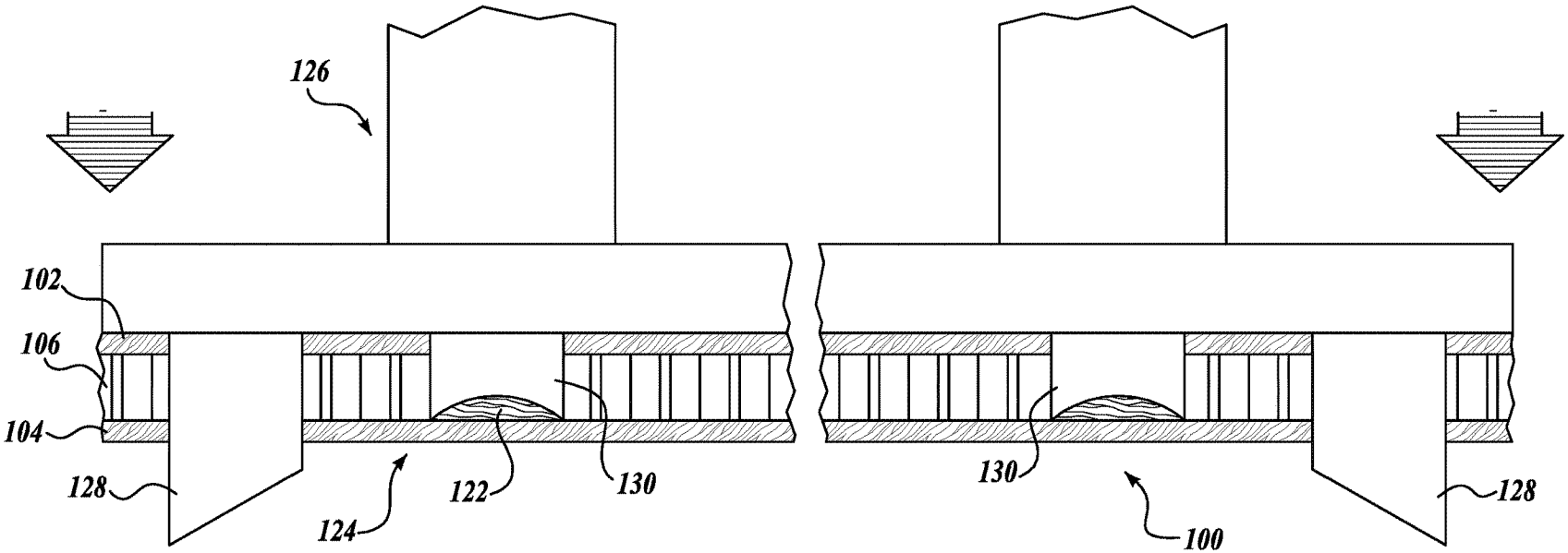
Figure 4C:
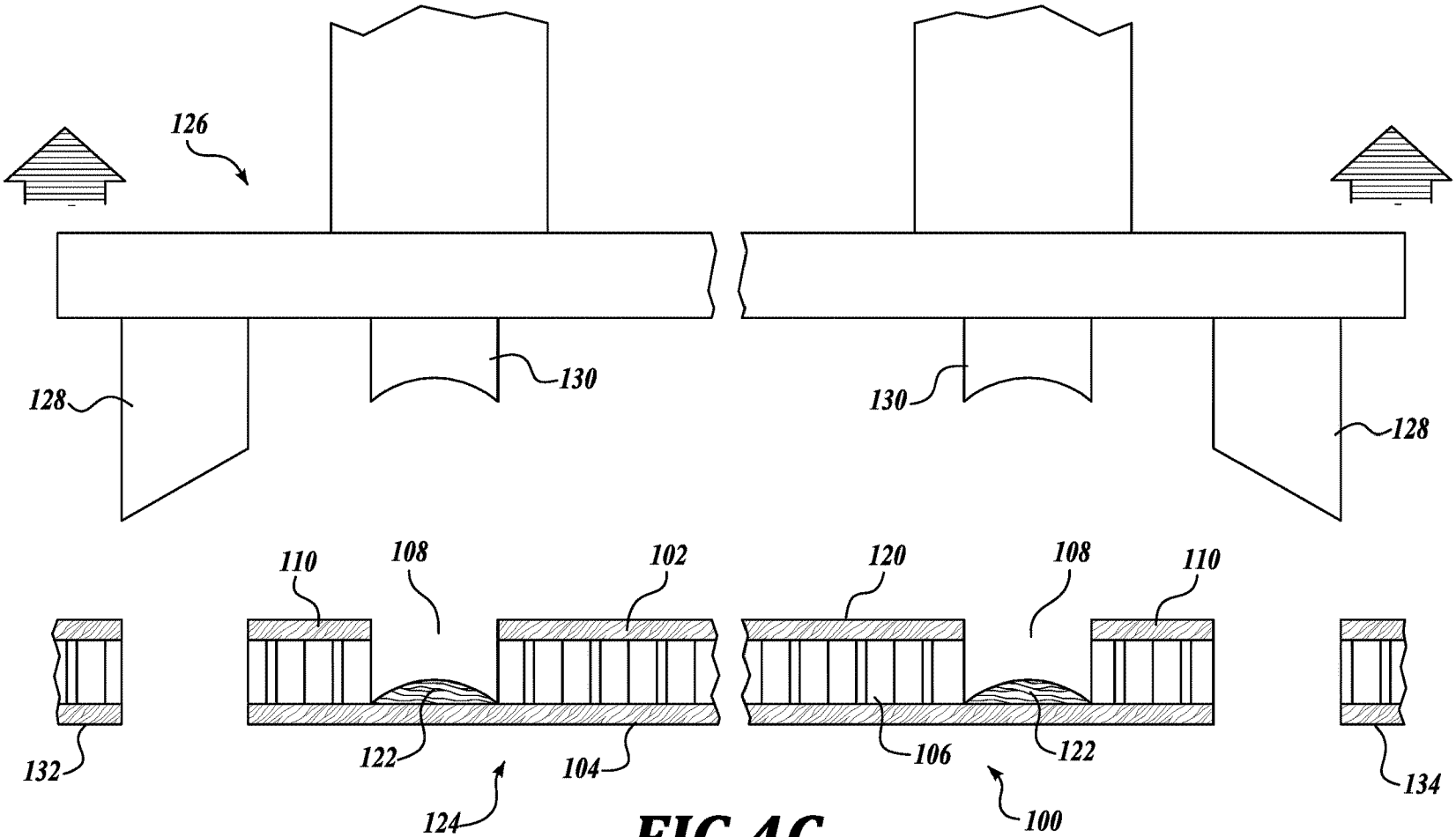

The top piece 100 has a number of cuts and seams that are formed by a die cutting process, as discussed in more detail with respect to FIGS. 4A to 4C. The top piece 100 has seams 108 and cuts 109 that form side panels 110. The top piece 100 also has seams 112 between pairs of the cuts 109 that form end panels 114. The top piece 100 also has seams 116 on the end panels 114 that, with the cuts 109, form tabs 118. The top piece 100 also includes a main panel 120 bounded by the seams 108 and the seams 112.

As seen in the cross-sectional side view in FIG. 3, the first layer 102 and a majority of the reinforced core 106 have been deformed in the area of the seam 108. The second layer 104 remains intact at the seam 108. As can also be seen in FIG. 3, a residual portion 122 of the first layer 102 and/or reinforced core 106 may remain in the seam 108. The residual portion 122 of the first layer 102 and/or reinforced core 106 may, in one embodiment, be an artifact of a single press die cut that creates the seams 108 and the cuts 109. In one embodiment, the width of the seam 108 is selected based on one or more of a thickness of the reinforced core cardboard, a desired angle of bend at the seam 108, and or any other factor. The other seams in the top piece, including the other seam 108, the seams 112, and the seams 116 can be formed in similar ways to the seam 108 depicted in FIG. 3. The cuts 109 are areas of the top piece 100 where the first layer 102, the second layer 104, and the reinforced core 106 have been removed. A side view of one of the cuts 109 is visible on the left side of FIG. 3.

An embodiment of a single press die cut to create the top piece 100 is depicted in the cross-sectional views in FIGS. 4A to 4C. In FIG. 4A, a panel 124 of reinforced core cardboard is located below a die 126. The panel 124 includes the first layer 102, the second layer 104, and the reinforced core 106 from which the top piece 100 is made. The die 126 includes several die components, including cutting components 128 and seam forming components 130.

FIG. 4B depicts the die 126 pressed into the panel 124. As shown, the die 126 is pressed with an amount of force and to a depth that causes the cutting components 128 to deform completely through the first layer 102, the reinforced core 106, and the second layer 104. The amount of force at which and the depth to which the die 126 is pressed also causes the seam forming components 130 to deform the first layer 102 and deform a majority of the reinforced core 106 while leaving the second layer 104 uncut to form seams.

In FIG. 4C, the die 126 has been lifted up after the press depicted in FIG. 4B. After the cuts made by the cutting components 128, the panel 124 has been separated into the top piece 100 and leftover pieces 132 and 134. The cuts made by the cutting components 128 form the outer edges of the top piece 100. However, in some embodiments, the die includes all of the cutting components that cut the outer dimensions of the top piece 100 and the cuts 109. The press of the seam forming components 130 formed the seams 108. The formed seams 108 define the side panels 110 and the main panel 120. The press of the seam forming components 130 leaves, in some embodiments, residual portions 122 of the first layer 102 and/or reinforced core 106 in the seam 108. In some embodiments, the die includes all of the seam forming components that form the seams 108, the seams 112, and the seams 116. In this case, where the die 126 includes all of the cutting components and seam forming components to form the top piece 100, the single press of the die 126 depicted in FIG. 4B forms the entire top piece 100 from the panel 124.

Figure 5:
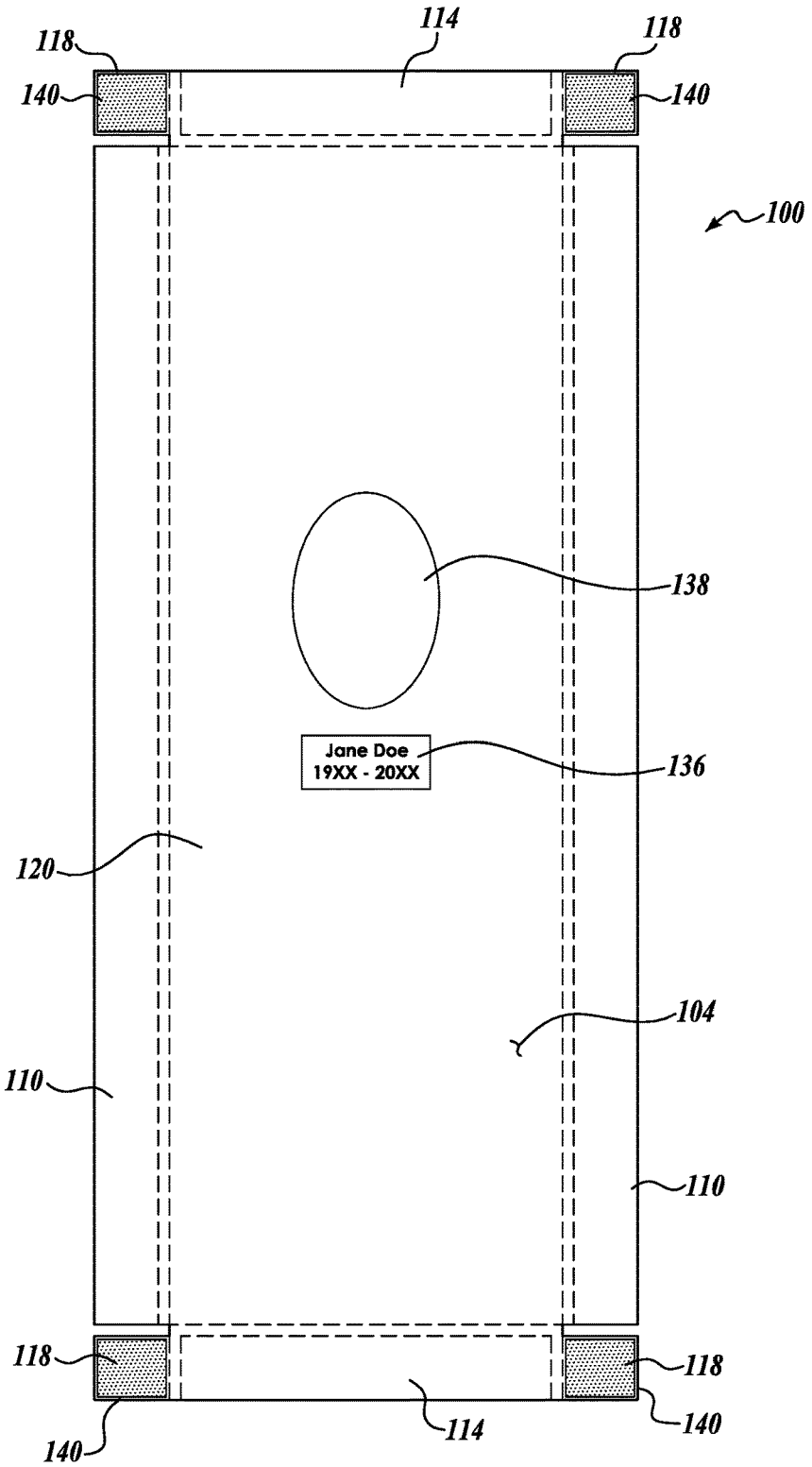
FIG. 5 depicts an embodiment of an outer surface of the second layer of the top piece depicted in FIGS. 2 and 3, in accordance with the embodiments disclosed herein.

In one embodiment, after the top piece 100 is die cut, the outer surface of the second layer 104 is prepared as depicted in FIG. 5. In one embodiment, after the top piece 100 is die cut, the outer surface of the second layer 104 is printed. In some examples, the printing includes one or more of text 136 and graphics 138. For example, the text 136 can include the name of the deceased, the years in which the deceased was born and died, a quotation, a poem, or any other text. In another example, the graphics 138 includes a picture of the deceased or any other image. In another embodiment not shown in FIG. 5, a background image is printed over most of the outer surface of the second layer 104 (e.g., printed on the outer surface of the second layer 104) that includes over most or all of the side panels 110, the end panels 114, and the main panel 120. Some examples of a background image include print patters, flowers, floral designs, landscape images, geometric patterns, books, animals, plants, patriotic flags, images or themes from popular culture (e.g., movies or television shows), sports teams, hobbies, constellations, and the like.

In one embodiment, the text, graphics, and/or background image on the outer surface of the second layer 104 of the top piece 100 are customized for the deceased. For example, a background image can be related to an interest of the deceased, the text 136 includes a name of the deceased, and the graphics 138 includes an image of the deceased. In one embodiment, customers are able to select the background image from pre-approved images and customers provide text and/or images for the text 136 and graphics 138. It may be advantageous to provide pre-approved images for selection by customers for the background image due to the resolution required for the image on a large surface, such as the top piece 100 of a cardboard casket. In one embodiment, a living person may pre-order and customize a cardboard casket while alive and the cardboard casket can be printed following the person's death. In other embodiments, surviving family or friends may order and customize a cardboard casket after a death.

In addition to printing on the outer surface of the second layer 104 of the top piece 100 after the top piece 100 is die cut, adhesive 140 can be added to portions of the second layer 104. In the embodiment depicted in FIG. 5, the adhesive 140 is added to portions of the tabs 118. In one example, the adhesive 140 is double-sided adhesive tape, with one side adhered to the tabs 118 and the other side covered by a film that can be removed when the cardboard casket is assembled. In one embodiment, after the top piece 100 is printed and the adhesive 140 is adhered to the tabs 118, the top piece 100 can be shipped to a customer, such as a funeral home or mortuary, in the flat condition depicted in FIG. 5.

Figure 6A:
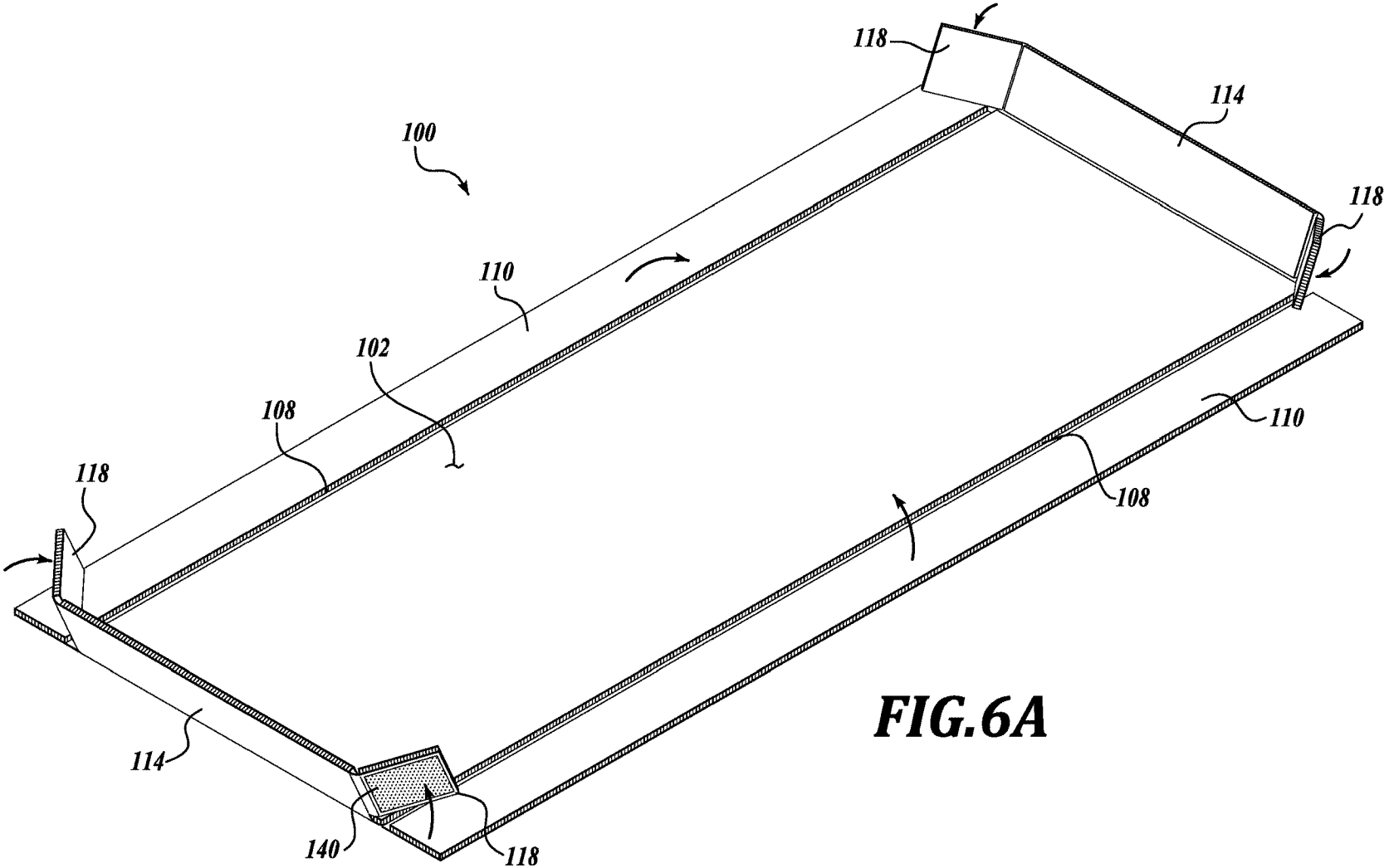
FIGS. 6A and 6B depict an embodiment of folding and adhering the top piece depicted in FIGS. 2 and 3 as part of the cardboard casket assembly process, in accordance with the embodiments disclosed herein.
Figure 6B:
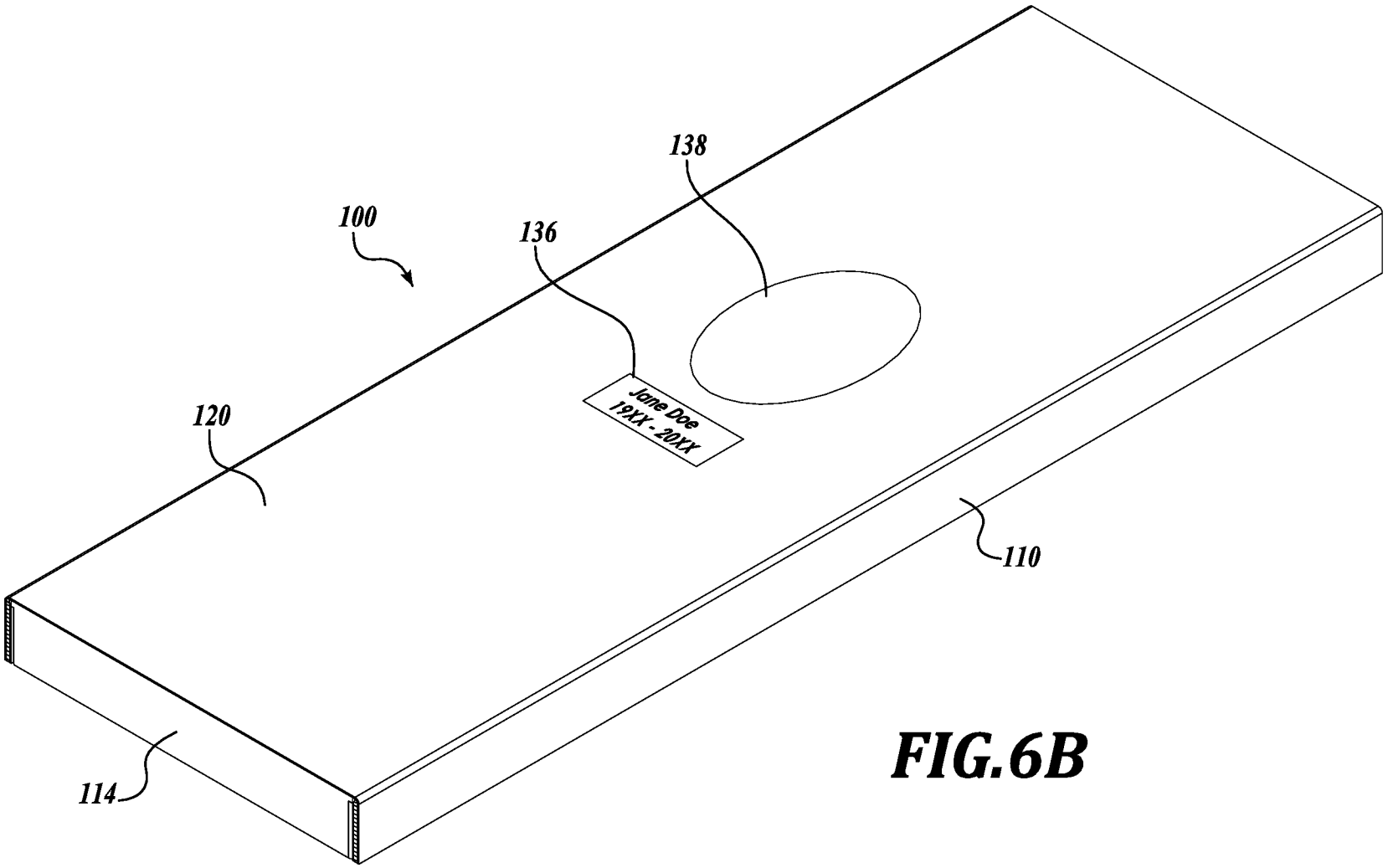

FIGS. 6A and 6B depict folding and adhering the top piece 100 as part of the cardboard casket assembly process. As shown in FIG. 6A, the end panels 114 are folded down along the seams 112 to form an angle between the end panels 114 and the main panel 120. The tabs 118 are also folded in along the seams 116 to form an angle between the tabs 118 and the end panels 114. In some examples, each of the angle between the end panels 114 and the main panel 120 and the angle between the tabs 118 and the end panels 114 is about 90°. At the point shown in FIG. 6A, the film over the adhesive 140 can be removed to expose the adhesive 140. As shown in FIG. 6B, the side panels 110 are folded down along the seams 108 to form an angle between the side panels 110 and the main panel 120. In this position, the side panels 110 are adhered to the adhesive 140 on the tabs 118. In the configuration shown in FIG. 6B, the top piece 100 is ready to be placed on a bottom piece to form a cardboard casket.

Figure 7:
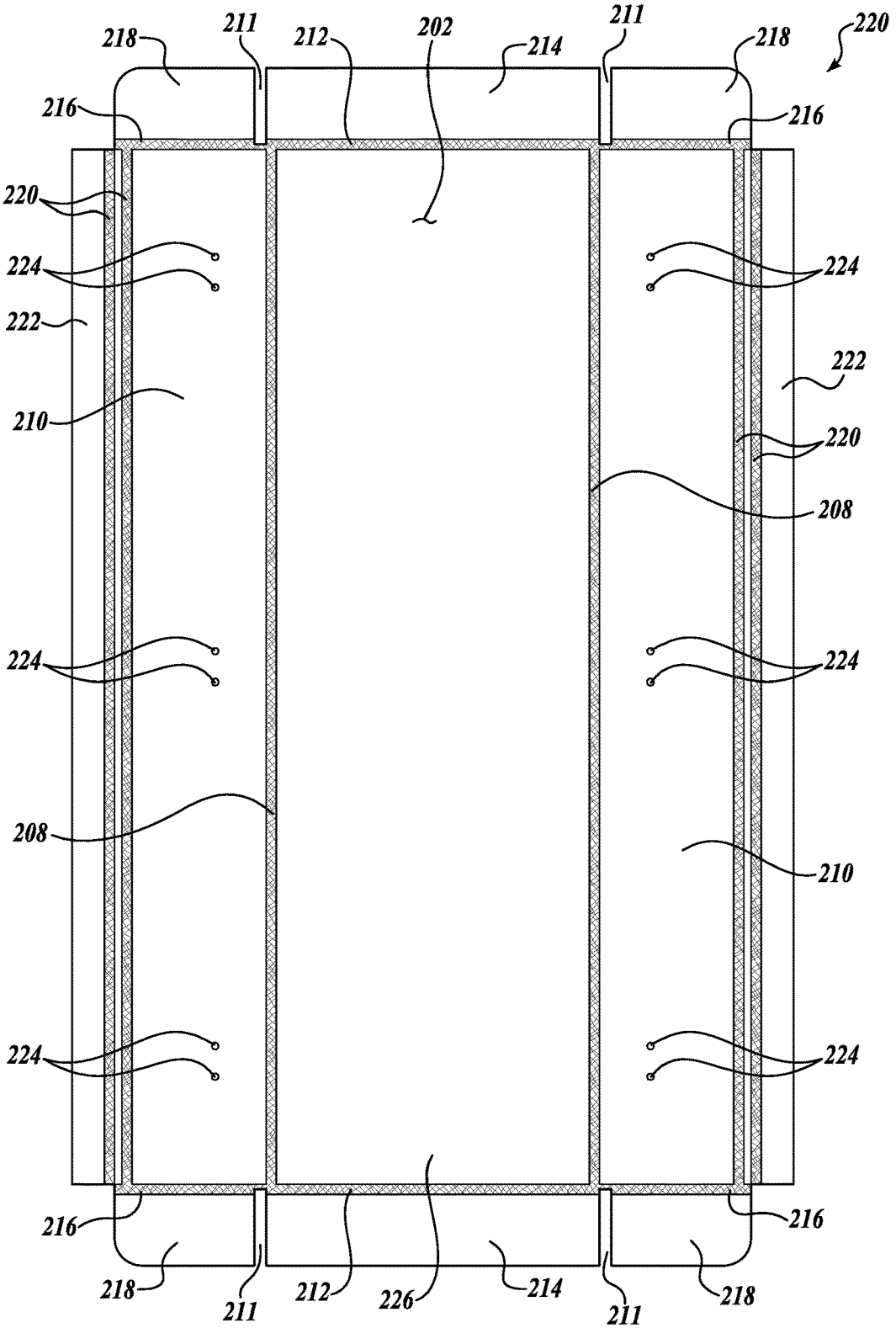
FIG. 7 depicts a view of one side of an embodiment of a bottom piece, in accordance with the embodiments disclosed herein.

FIG. 7 depicts a view of one side of the bottom piece 200. The bottom piece 200 is formed from reinforced core cardboard having a first layer 202, a second layer 204, and a reinforced core 206 between the first and second layers 202 and 204. In some embodiments, the first layer 202, the second layer 204, and the reinforced core 206 have characteristics similar to the first layer 22, the second layer 24, and the reinforced core 26 described above with respect to FIG. 1.

The bottom piece 200 has a number of cuts and seams that are formed by a die cutting process, similar to the die cutting process discussed above with respect to FIGS. 4A to 4C. The bottom piece 200 has seams 208 between a main panel 226 and side panels 210. The bottom piece 200 also has seams 212 between the main panel 226 and end panels 214. The end panels 112 are further defined by cuts 211. The bottom piece 200 also has seams 216 between the side panels 210 and tabs 218. The cuts 211 are located between the end panels 112 and the tabs 218. The bottom piece 200 also has pairs of seams 220 between the side panels 210 and ledge panels 222. The side panels 210 also include pairs of handle holes 224.

In one embodiment, the bottom piece 200 is formed from a reinforced core cardboard panel using a single press die cut, similar to the single press die cut of the top piece 100 described above with respect to FIGS. 4A to 4C. For example, the outer dimensions and the cuts 211 of the bottom piece 200 can be cut by cutting components on a die. As described above, the cuts 211 pass through the first layer 202, the reinforced core 206, and the second layer 206. In another example, the seams 208, the seams 212, the seams 216, and the pairs of seams 220 are pressed using seam forming components. As described above, the seam forming components pass deform the first layer 202 and a majority of the reinforced core 206 while leaving the second layer 204 uncut. The seam forming components may leave some residual portions of the first layer 202 and/or the reinforced core 206 in the seams. In another example, the die includes punches that pass through the first layer 202, the reinforced core 206, and the second layer 206 to form the pairs of handle holes 224.

Figure 8A:
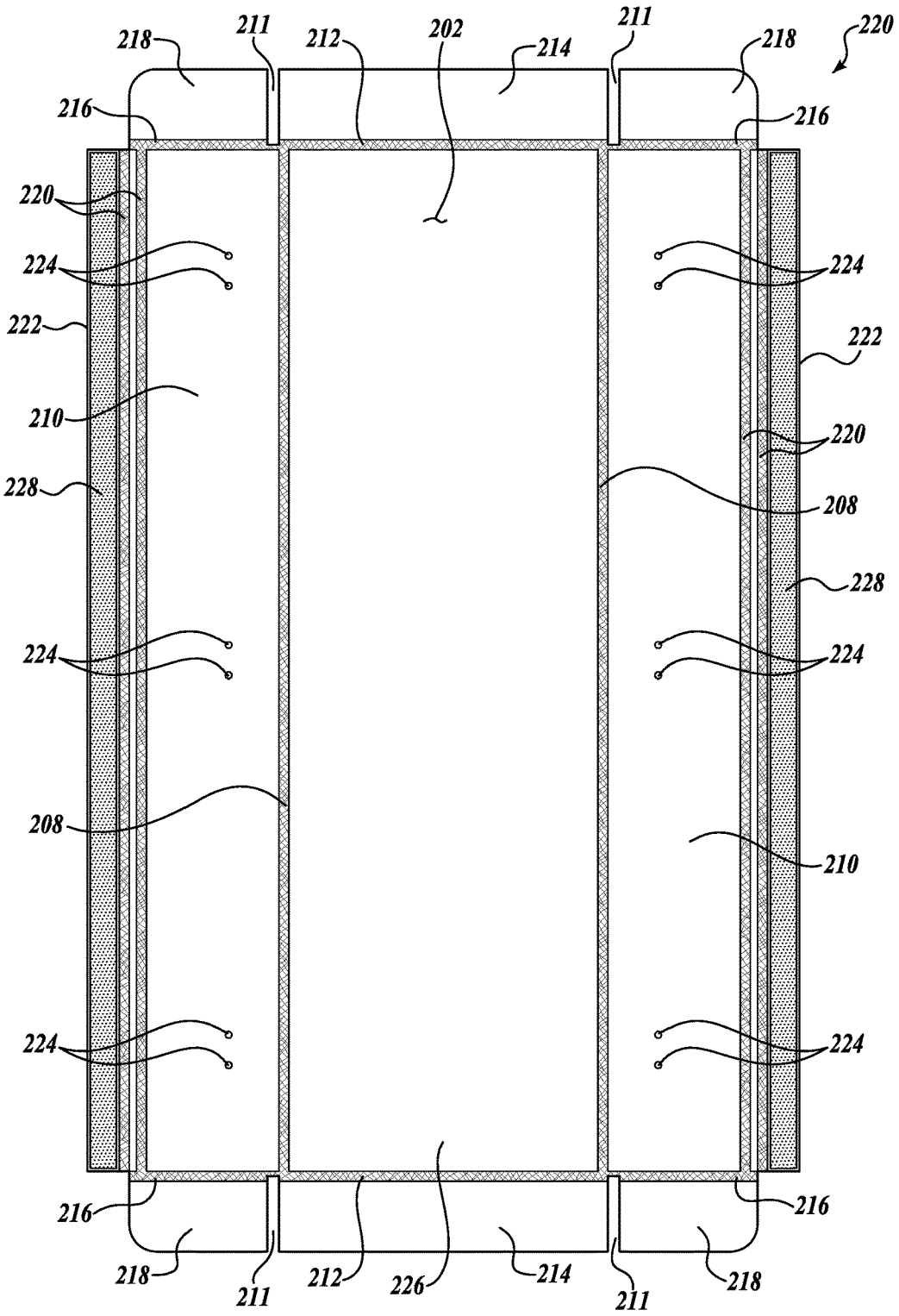
FIGS. 8A and 8B depict, respectively, a view of a first layer and a view of the second layer of the bottom piece depicted in FIG. 7 after the bottom piece has been die cut, in accordance with the embodiments disclosed herein.
Figure 8B:
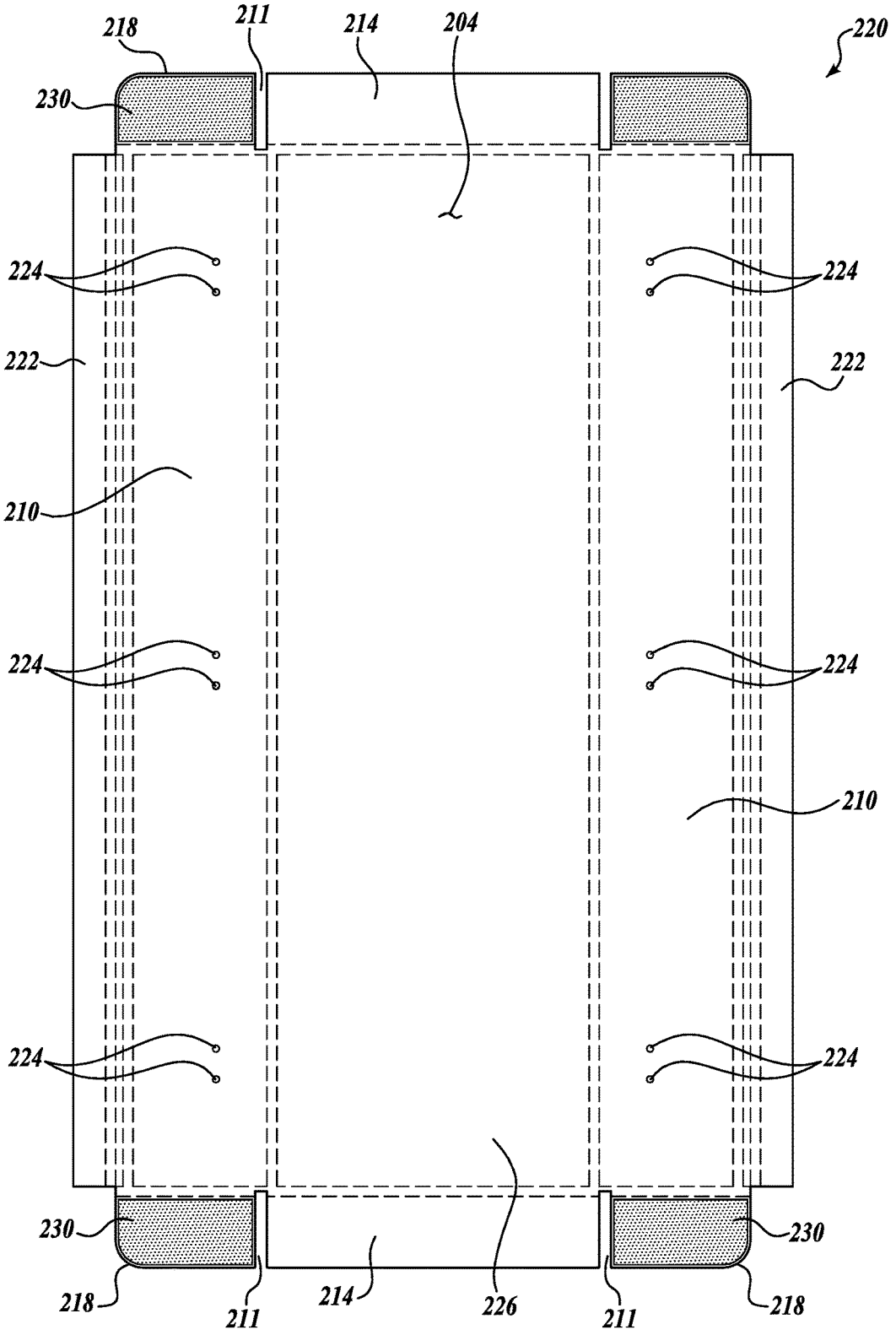

FIGS. 8A and 8B depict, respectively, a view of the first layer 202 and a view of the second layer 204 of an embodiment of the bottom piece 200 after the bottom piece 200 has been die cut. In FIG. 8A, adhesive 228 is placed on the outer surface of the first layer 202 along the ledge panels 222. In FIG. 8B, adhesive 230 is placed on the outer surface of the second layer 204 on the tabs 218. In one example, the adhesive 228 and the adhesive 230 include double-sided adhesive tape, with one side adhered to the ledge panels 222 or the tabs 218 and the other side covered by a film that can be removed when the cardboard casket is assembled.

The outer surface of the second layer 204 of the bottom piece 200 can also have printing. In one example, the outer surface of the second layer 204 may be printed before the bottom piece 200 is die cut. For example, the outer surface of the second layer 204 may be a single color (e.g., black) or have a basic pattern (e.g., wood grain) before it is die cut. A single color or a basic pattern may be usable with many of the customizable images on the top piece 100 such that the bottom pieces do not need customized printing. After the bottom piece 200 is die cut, the pre-printed outer surface of the second layer 204 will be ready for assembly. In another example, the outer surface of the second layer 204 may be printed after the bottom piece 200 is die cut. Printing the bottom piece 200 after die cutting may allow for customization with text, graphics, background images, and like, similar to the customization of the top piece 100 described above. In one embodiment, after the bottom piece 200 is printed and/or the adhesive 228 and 230 is adhered to the bottom piece 200, the bottom piece 200 can be shipped to a customer, such as a funeral home or mortuary, in the flat condition depicted in FIGS. 8A and 8B.

Figure 9A:
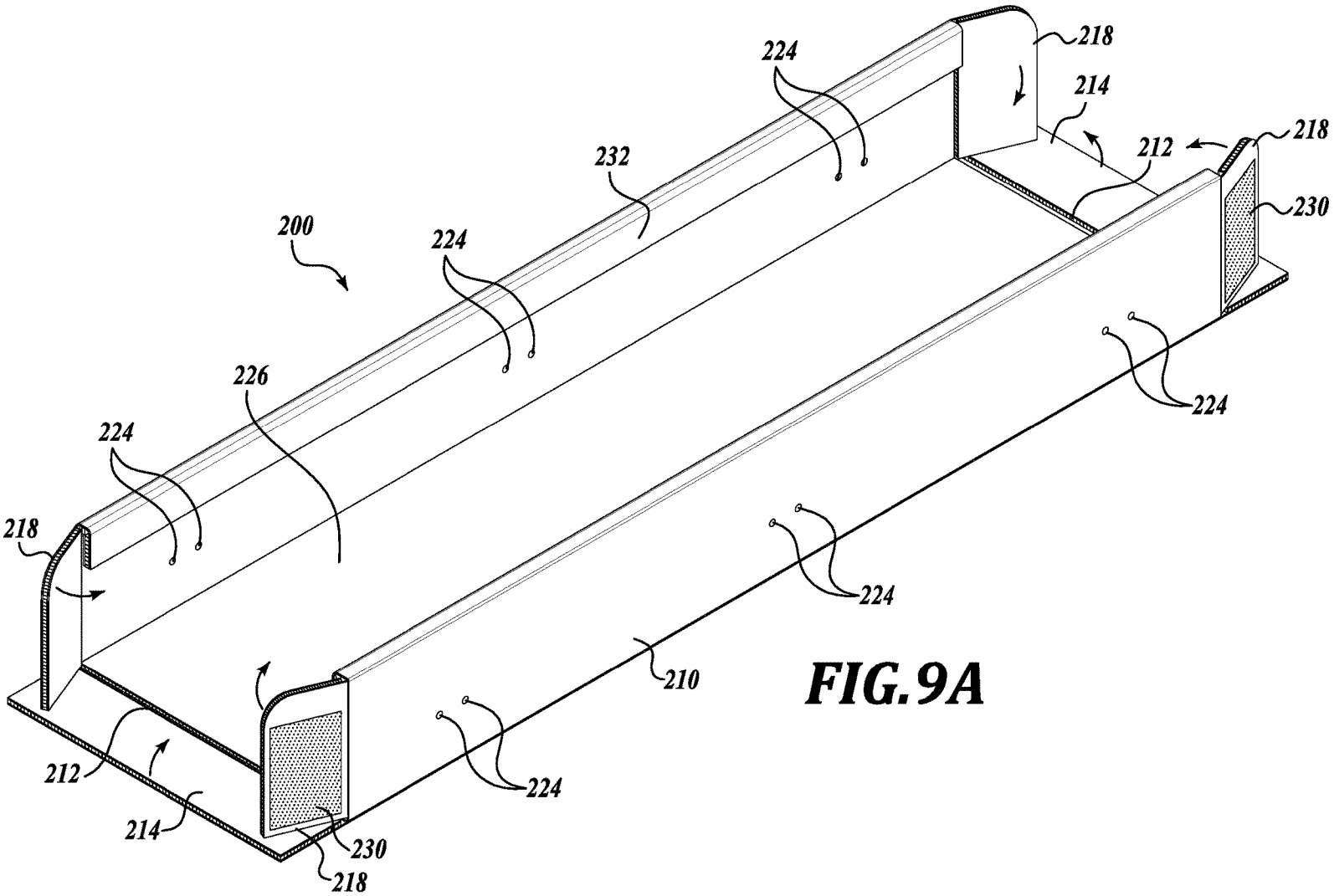
FIGS. 9A and 9B depict an embodiment of folding and adhering the bottom piece depicted in FIG. 7 as part of the cardboard casket assembly process, in accordance with the embodiments disclosed herein.
Figure 9B:
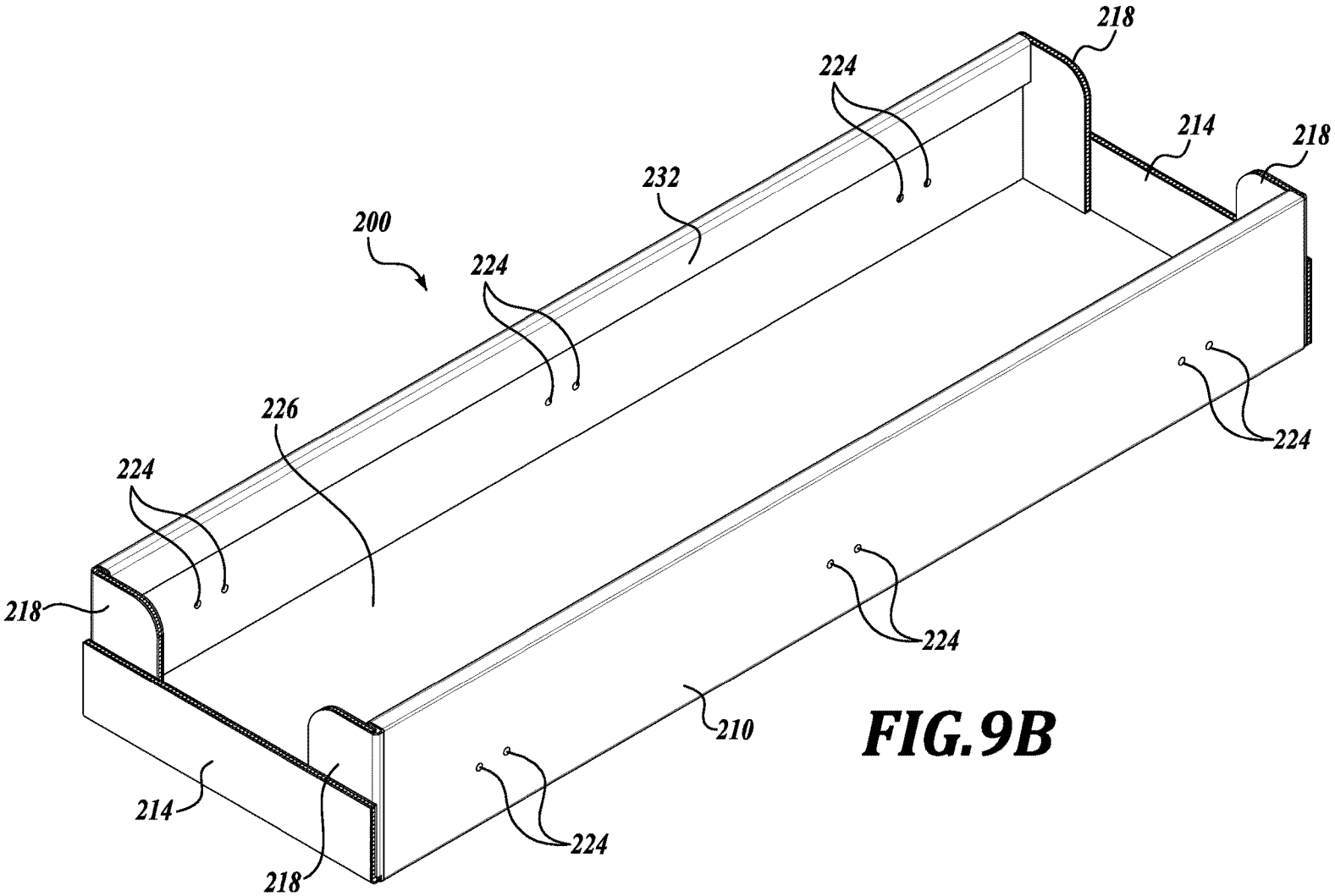

FIGS. 9A and 9B depict folding and adhering the bottom piece 200 as part of the cardboard casket assembly process. As shown in FIG. 9A, the side panels 210 are folded up along the seams 208 to form an angle between the side panels 210 and the main panel 226. In one example, the angle between the side panels 210 and the main panel 226 is about 90°. The ledge panels 222 are folded down along pairs of seams 220 toward the side panels 210 such that each of the ledge panels 222 is substantially parallel to one of the side panels 210. Any film over the adhesive 228 can be removed prior to folding the ledge panels 222 such that the adhesive 228 on the ledge panels 222 adheres to a portion of the side panels 210. In one example, the angle formed at each of the seams 220 is about 90° such that the angle formed by each of the pairs of seams 220 is about 180°. The folding along the pairs of seams 220 creates ledges 232 that are approximately twice the width of the reinforced core cardboard panel from which the bottom piece 200 is formed. The ledges 232 add structural rigidity to the sides of the bottom piece 200 and can appear more aesthetically pleasing than a cut end of the reinforced core cardboard panel.

The tabs 218 are also folded in along the seams 216 to form an angle between the tabs 218 and the side panels 210. In one example, the angle between the tabs 218 and the side panels 210 is about 90°. At the point shown in FIG. 9A, any film over the adhesive 230 can be removed to expose the adhesive 230. As shown in FIG. 9B, the end panels 214 are folded up along the seams 212 to form an angle between the end panels 214 and the main panel 226. In this position, the end panels 214 are adhered to the adhesive 230 on the tabs 218. In the configuration shown in FIG. 9B, the bottom piece 200 is ready to have a top piece placed on it to form a cardboard casket.

Figures 10A, 10B:
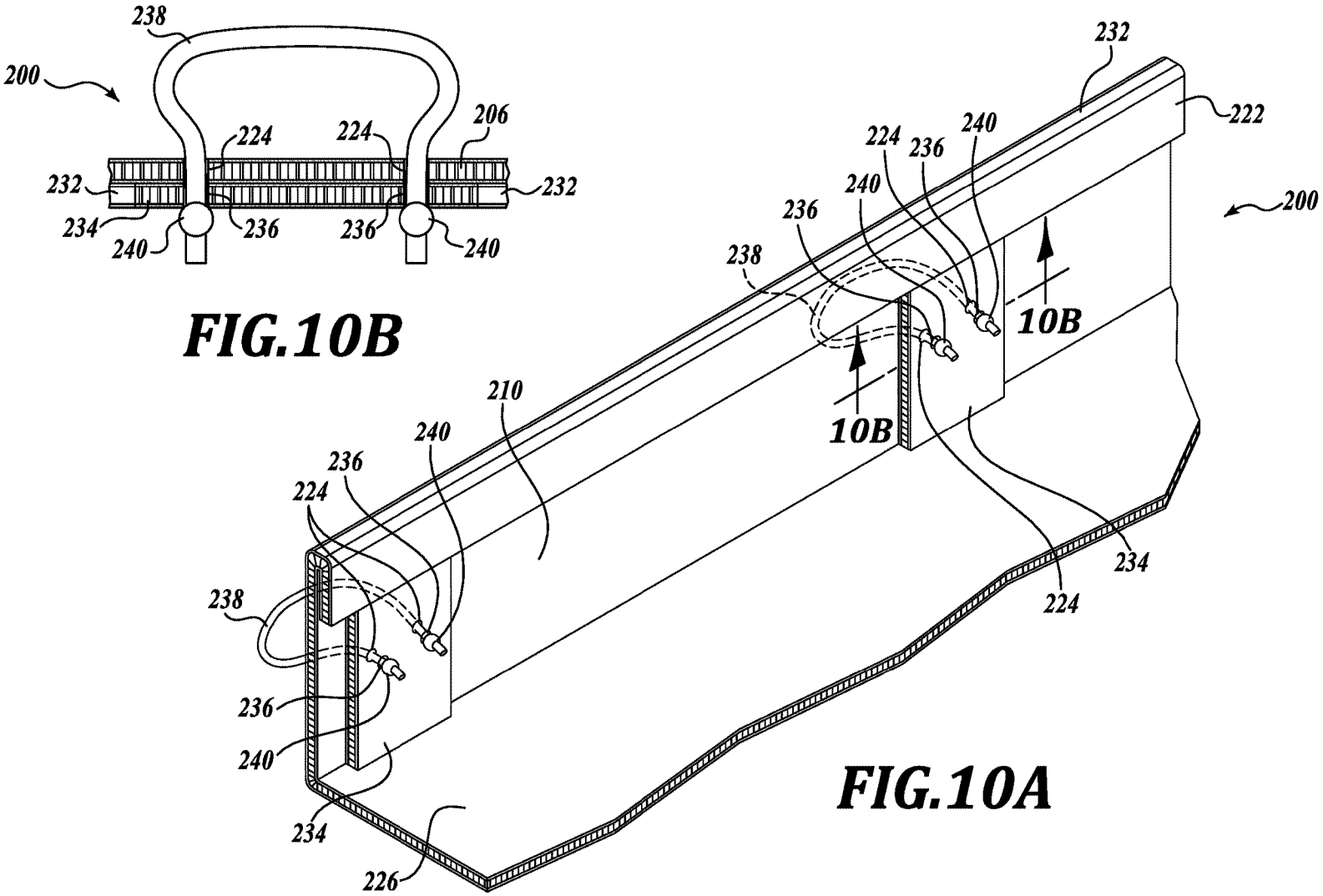
FIGS. 10A and 10B depict an embodiment of reinforcement of handle holes of the bottom piece depicted in FIG. 7 and the addition of handles to the bottom piece depicted in FIG. 7, in accordance with the embodiments disclosed herein.

FIGS. 10A and 10B depict reinforcement of the handle holes 224 of the bottom piece 200 and the addition of handles to the bottom piece 200. In the embodiment shown in FIG. 10A, reinforcement pieces 234 are placed against side panels 210 under the ledge panels 222. In one embodiment, the reinforcement pieces 234 are made from the same or a similar reinforced core cardboard panel as the bottom piece 200. In other embodiments, the reinforcement pieces 234 are made from other reinforcing materials, such as plastic, composite materials, and the like. In one embodiment, a thickness of the reinforcement pieces 234 is approximately the same as a thickness of the ledge panel 222.

Each of the reinforcement pieces 234 has a pair of handle holes 236. In one embodiment, the handle holes 236 have a size corresponding to a size of the handle holes 224 in the side panels 210. In another embodiment, each pair of handle holes 236 is spaced apart at a distance corresponding to a spacing of the handle holes 224 in the side panels 210. In another embodiment, each of the reinforcement pieces 234 is placed against the side panel 210 such that the pairs of handle holes 236 are aligned with the pairs of handle holes 224 in the side panels 210.

In the embodiment shown in FIG. 10B, a handle 238 is attached to the bottom piece 200. Ends of the handle 238 are fed through the pairs of handle holes 224 in the side panel 210 and through the pairs of handle holes 236 in the reinforcement piece 234. In some embodiments, the handle 238 is formed from a flexible material, such as rope, cord, line, string, or twine. In some embodiments, the handle 238 is made from natural or synthetic fibers. In the embodiment depicted in FIG. 10B, knots 240 are formed in each of the ends of the handle 238. The knots 240 are configured to prevent the ends of the handle 238 from being pulled back through the pairs of handle holes 236 in the reinforcement piece 234 and through the pairs of handle holes 224 in the side panel 210. Handles similar to the handle 238 depicted in FIG. 10B can be added to the side panels 210 at each of the pairs of holes 224. While the embodiment of the handle 238 is formed from a flexible material, in other embodiments, the handle 238 can be formed from other materials, such as wood, cardboard, or any other nonflexible material. In the case of a handle formed from a nonflexible material, mechanical fasteners (e.g., screws) may be passed through the pairs of handle holes 236 in the reinforcement piece 234 and the pairs of handle holes 224 in the side panel 210 to fasten the handle 238 to the side panel 210.

Figure 11A:
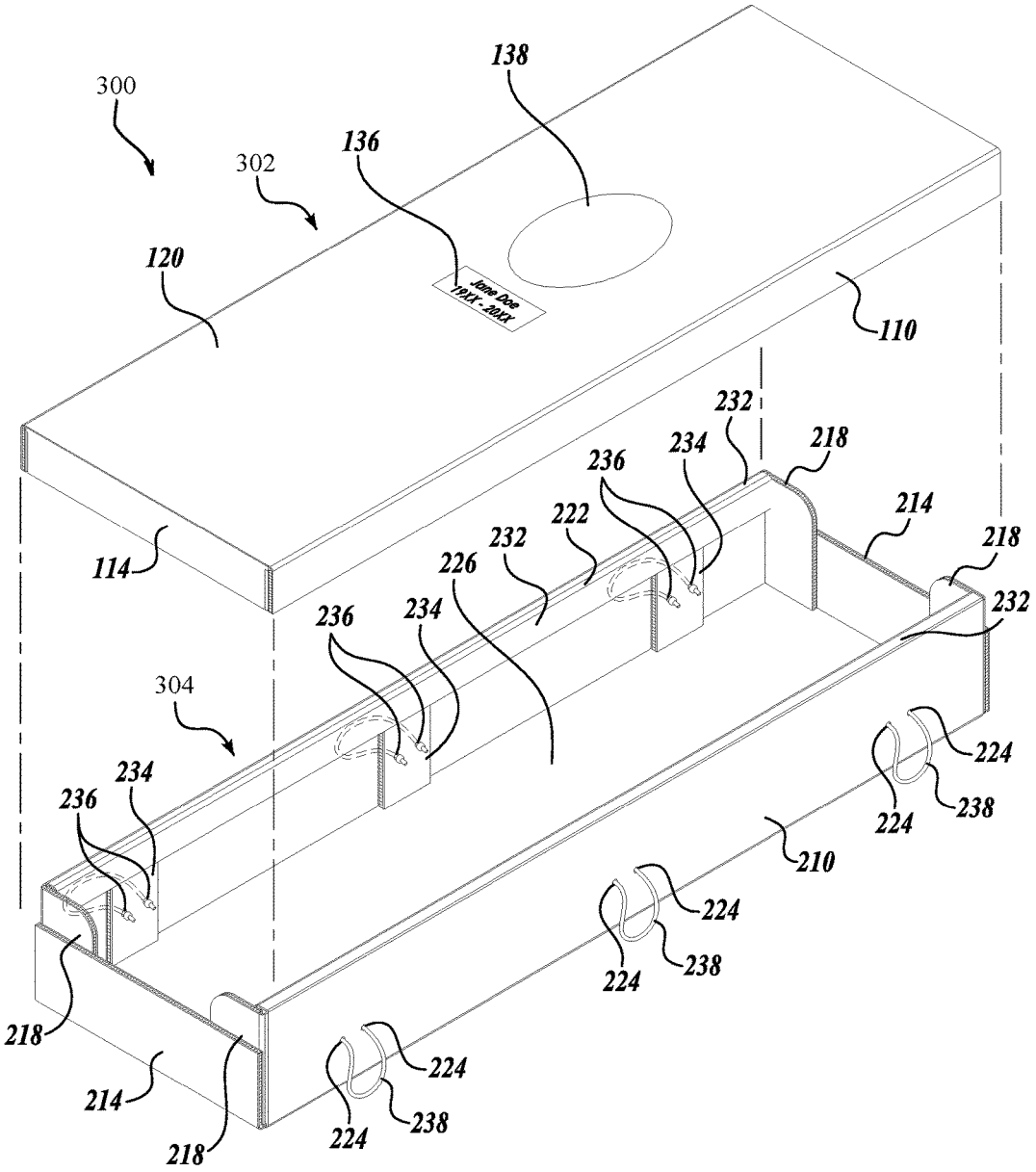
FIGS. 11A and 11B depict an embodiment of a cardboard casket assembly process, in accordance with the embodiments disclosed herein.
Figure 11B:
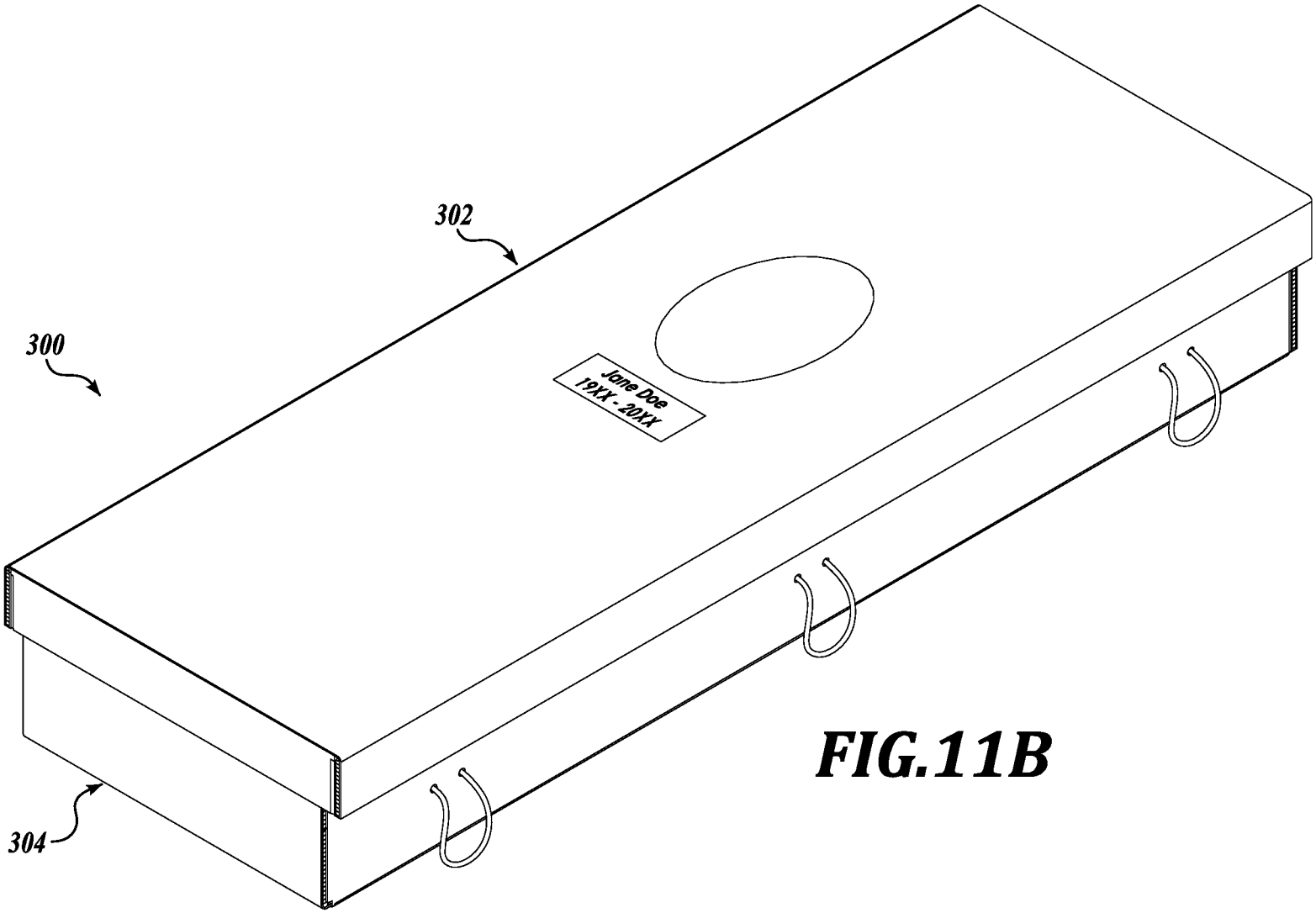

FIGS. 11A and 11B depict an embodiment of a cardboard casket 300 assembly process. The cardboard casket 300 includes a top piece 302 and a bottom piece 304. In one embodiment, the top piece 302 is formed from a single press die cut reinforced core cardboard panel, such as the top piece 100 described above. In one embodiment, the bottom piece 304 is formed from a single press die cut reinforced core cardboard panel, such as the bottom piece 200 described above. The top piece 302 and the bottom piece 304 can be formed into the configurations shown in FIGS. 11A and 11B, such as by folding along seams and adhering particular portions of the top piece 302 and the bottom piece 304.

After the top piece 302 and the bottom piece 304 are formed, human remains can be placed into the bottom piece 304. In some embodiments, the weight of the human remains may exceed an upper weight limit of the bottom piece 304. In those cases, a tray (not shown) can be added to the inside of the bottom piece 304 prior to the human remains being placed in the bottom piece 304. The tray can add structural integrity to the bottom piece 304 and increase the weight holding capacity of the bottom piece 304.

After human remains are placed into the bottom piece 304, the top piece 302 can be placed over the bottom piece 304, as shown in FIG. 11A, and then the top piece 302 can be pressed down onto the bottom piece 304 to the position depicted in FIG. 11B. In one embodiment, dimensions of the top piece 302 and the bottom piece 304 are selected such that a press fit is created between the top piece 302 and the bottom piece 304. The press fit fastens the top piece 302 to the bottom piece 304 using friction such that a greater force is required to remove the top piece 302 from the bottom piece than was required to press the top piece 302 onto the bottom piece 304. In another embodiment, the top piece 302 is fastened to the bottom piece 304 using other fasteners, such as mechanical fasteners or adhesive.

After the top piece 302 is fastened to the bottom piece 304, the cardboard casket 300 is suitable for use in a memorial service or funeral, in burial or entombment, or in cremation. In one embodiment, the materials used in the cardboard casket 300 (e.g., reinforced core cardboard, adhesive, handles, etc.) are biodegradable materials that will degrade over time after burial. In one embodiment, the materials used in the cardboard casket 300 are combustible such that the entire cardboard casket 300 with the human remains inside can be used in a cremation process. In another embodiment, most of the materials used in the cardboard casket 300 are combustible and the non-combustible materials are removable from the cardboard casket 300 such that the combustible portions of the cardboard casket 300 with the human remains inside can be used in a cremation process.

Figure 12A:
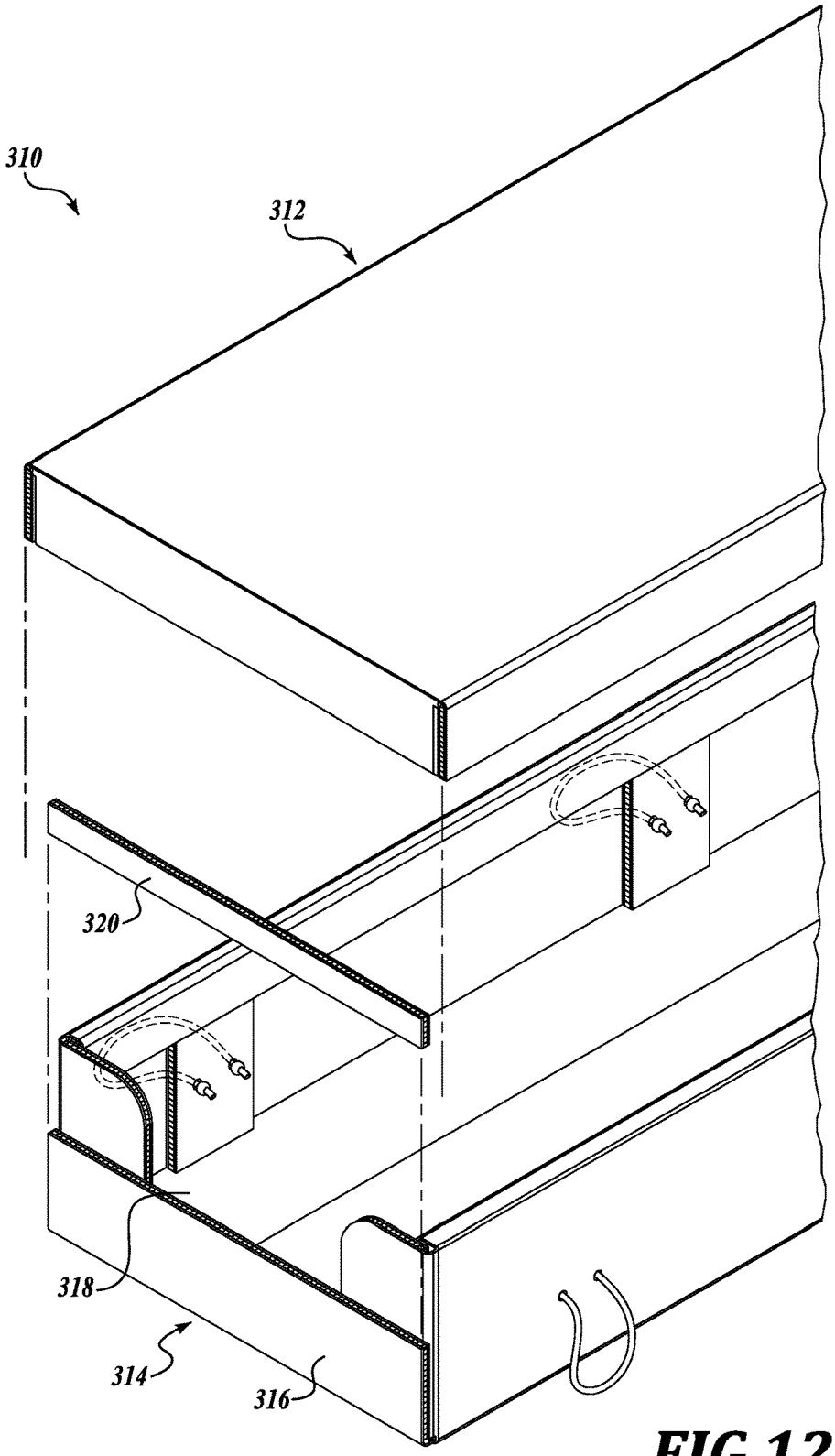
FIGS. 12A to 12C depict an embodiment of a cardboard casket with a top piece and a bottom piece, in accordance with the embodiments disclosed herein.
Figure 12B:
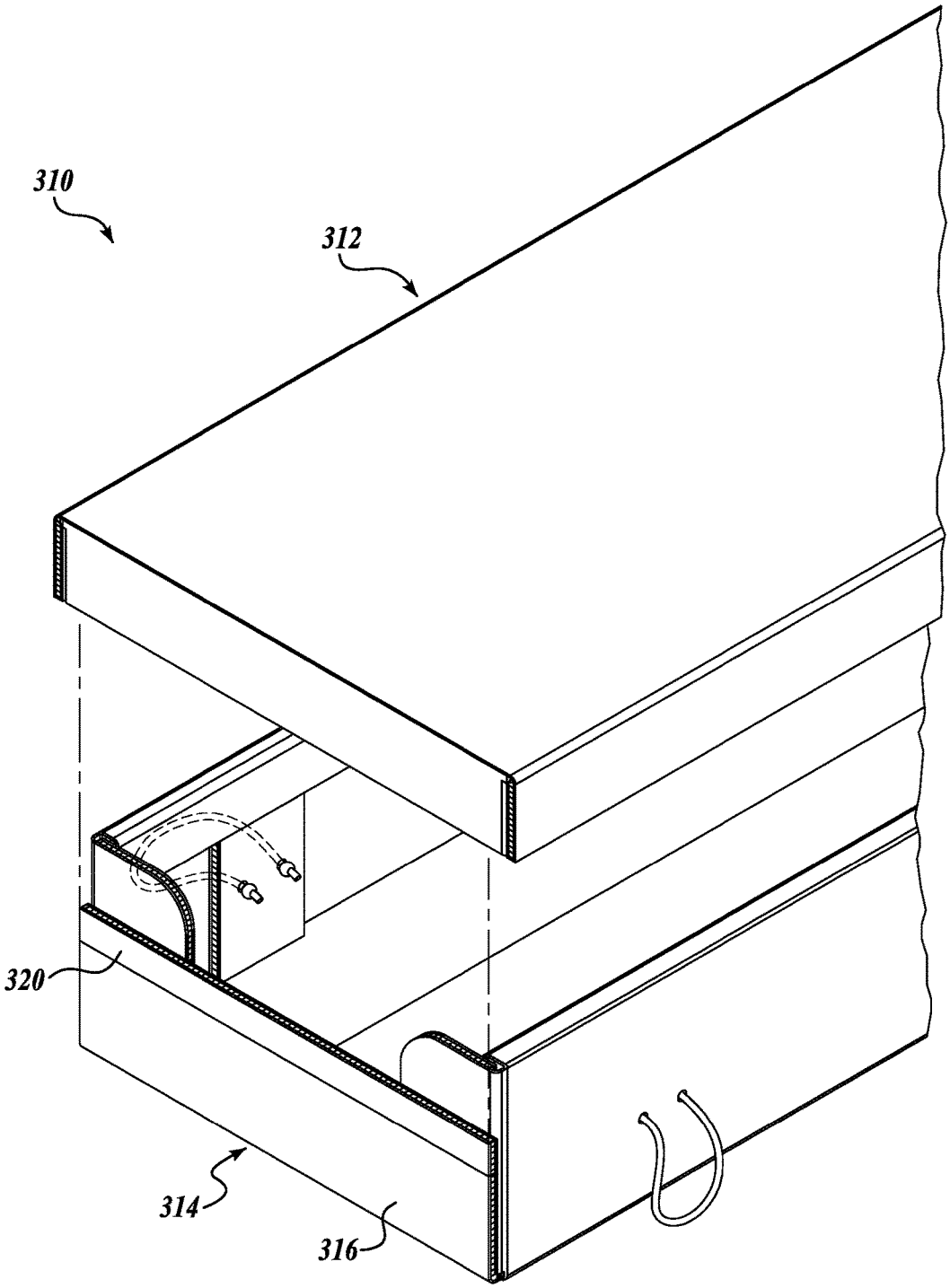
Figure 12C:
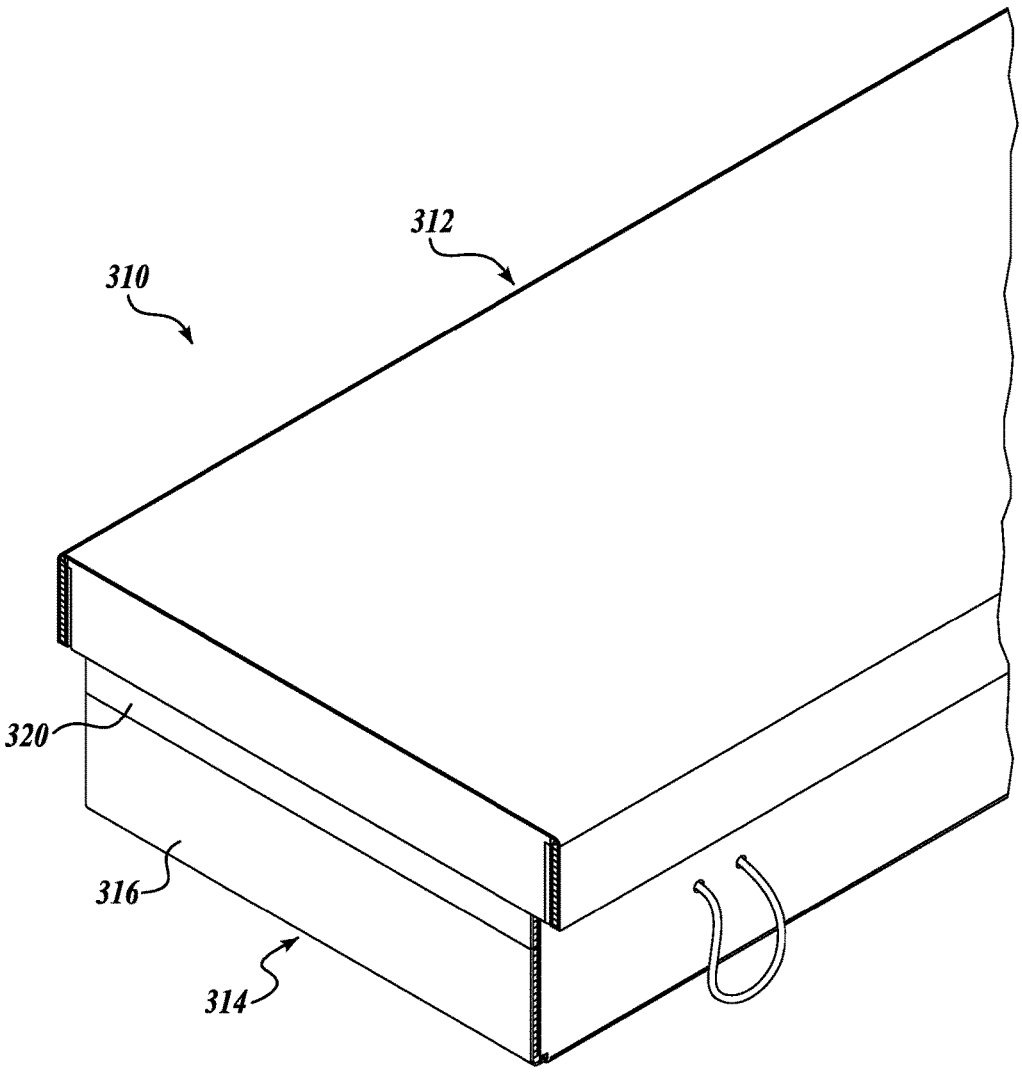

FIGS. 12A to 12C depict an embodiment of a cardboard casket 310 with a top piece 312 and a bottom piece 314. In one embodiment, the top piece 312 is formed from a single press die cut reinforced core cardboard panel, such as the top piece 100 described above. In one embodiment, the bottom piece 314 is formed from a single press die cut reinforced core cardboard panel, such as the bottom piece 200 described above. FIG. 12A depicts an end view of the cardboard casket 310 with the top piece 312 pressed onto the bottom piece 314. The bottom piece 314 includes an end panel 316. In the embodiment shown in FIG. 12A, the end panel 316 does not extend to the top piece 312, leaving a gap 318 between the top piece 312 and the bottom piece 314. In one embodiment, the gap 318 may exist due to a limitation on the size of the end panel 316. One example of such a limitation is discussed below with respect to FIG. 13A.

Having a gap 318 between the top piece 312 and the bottom piece 314 of the cardboard casket 310 is typically not an acceptable configuration, particularly when the cardboard casket 310 is used to hold human remains. FIGS. 12B and 12C depict a solution to cover the gap 318. In FIG. 12B, an extension piece 320 is added to the bottom piece 314 (e.g., adhered to tabs of the bottom piece 314) just above the end panel 316. In one embodiment, the outer surface of the extension piece 320 has a color and/or pattern similar to the outer surface of the end panel 316. In this way, the extension piece 320 may appear to be a part of the end panel 316. After the top piece 312 is pressed down on the bottom piece 314, as shown in FIG. 12C, the extension piece 320 extends between the end panel 316 and the top piece 312 such that the gap 318 no longer exists.

Figure 13A:
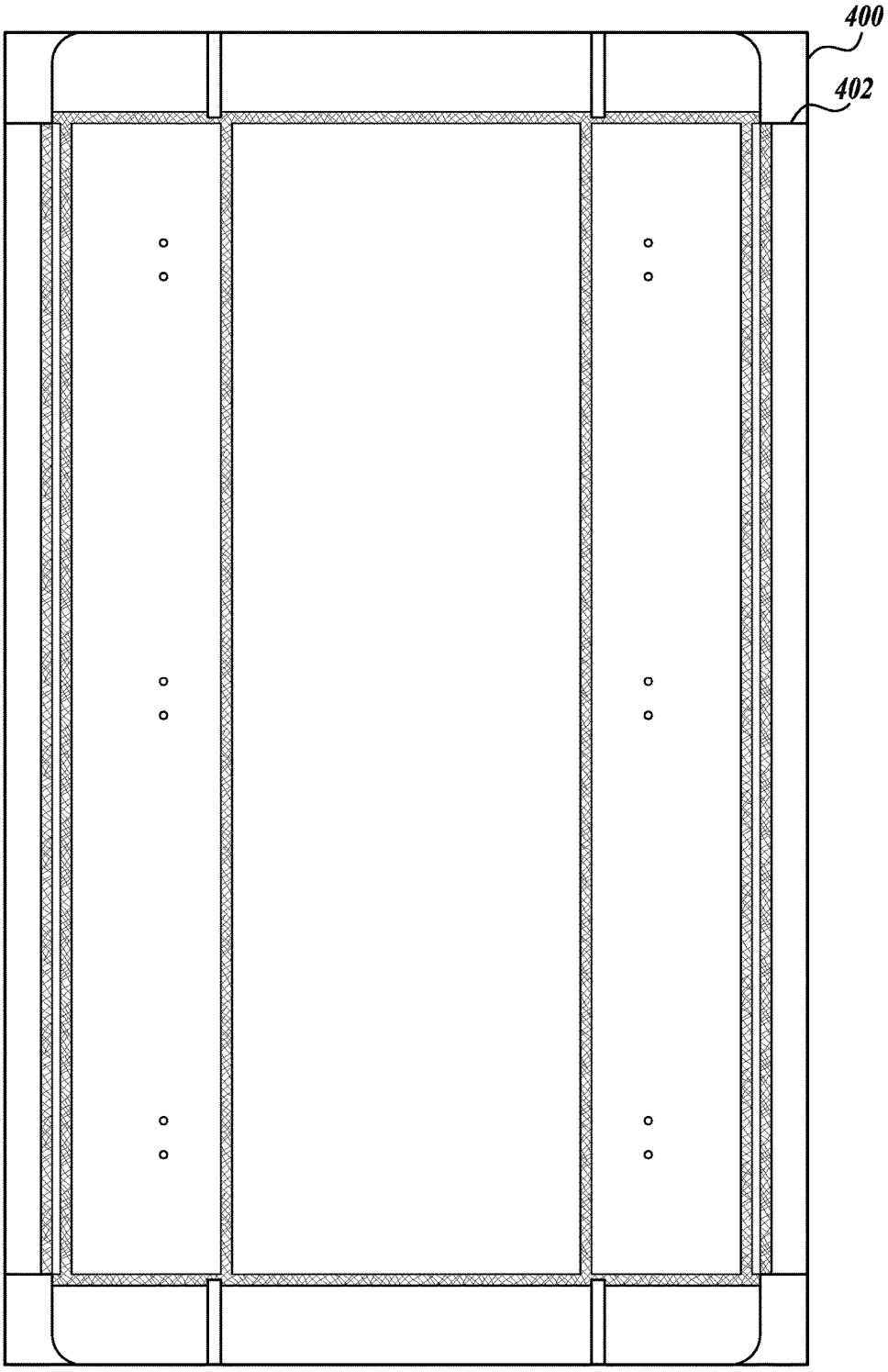
FIGS. 13A and 13B depict embodiments of panels of reinforced core cardboard that can be die pressed to form, respectively, top and bottom pieces of a cardboard casket, in accordance with the embodiments disclosed herein.
Figure 13B:
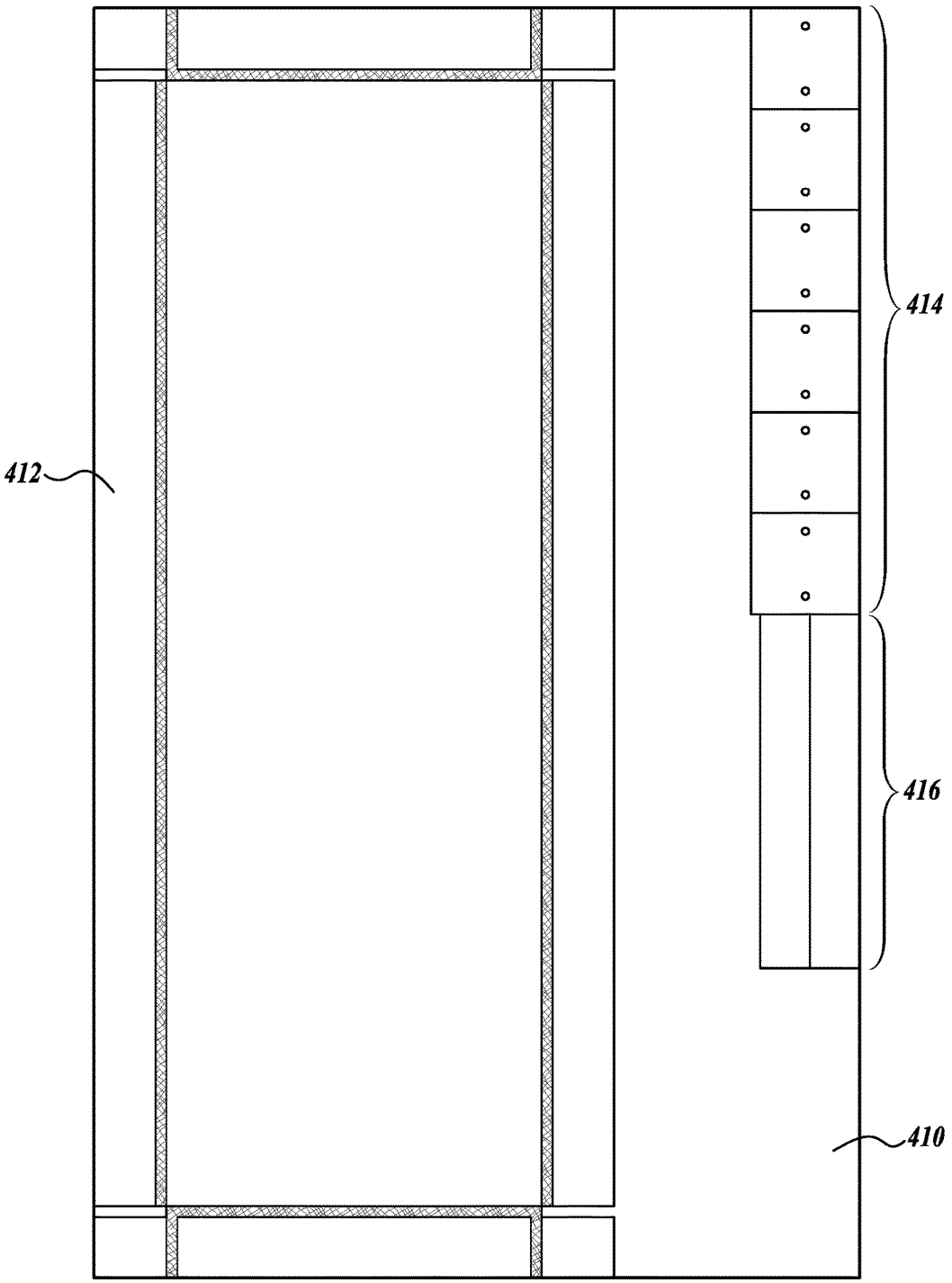
Figure 14:
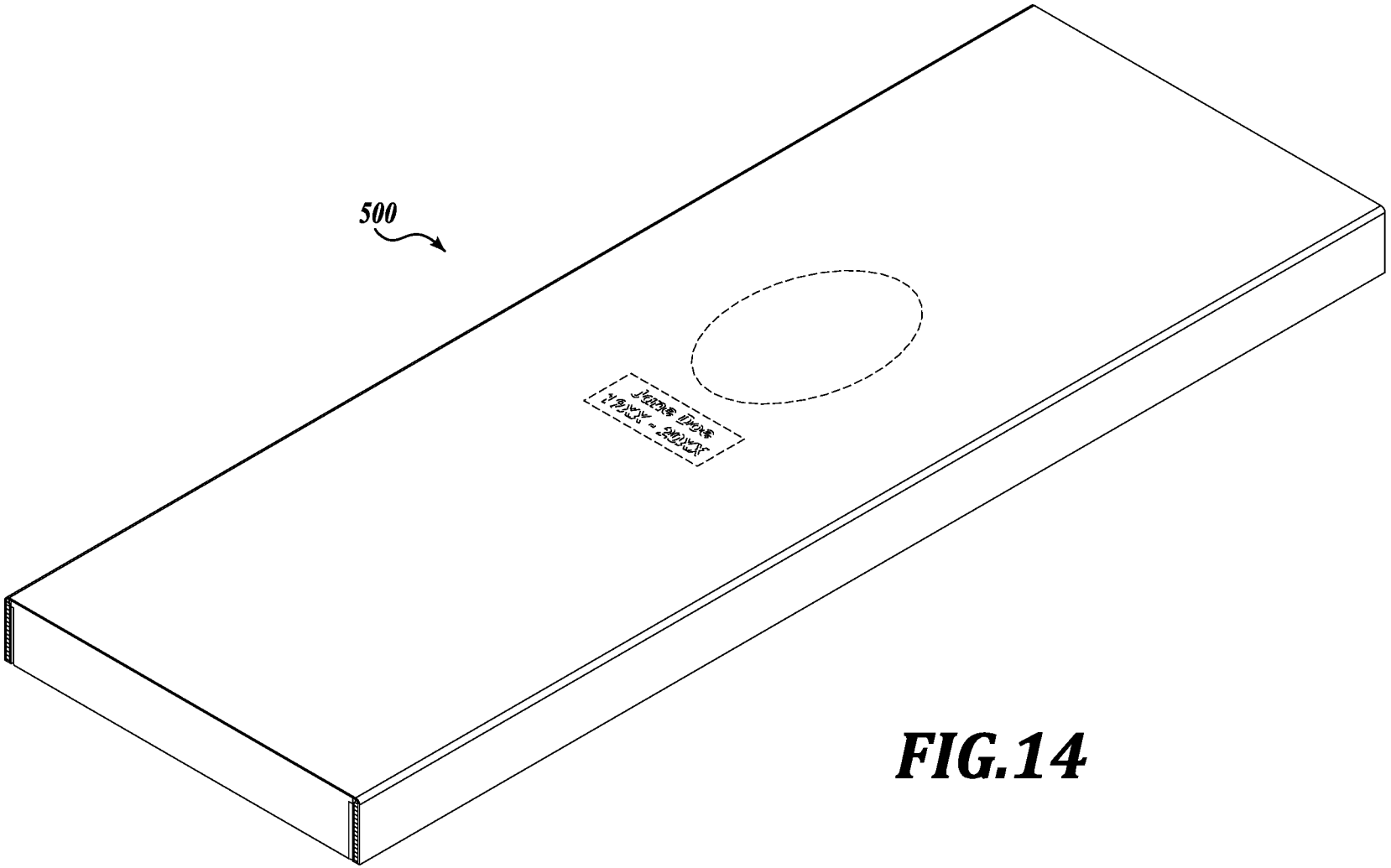
FIGS. 14 to 18 depict, respectively, a perspective view, a top view, a bottom view, an end view, and a side view of an embodiment of a top piece of a cardboard casket, in accordance with the embodiments disclosed herein.
Figure 15:
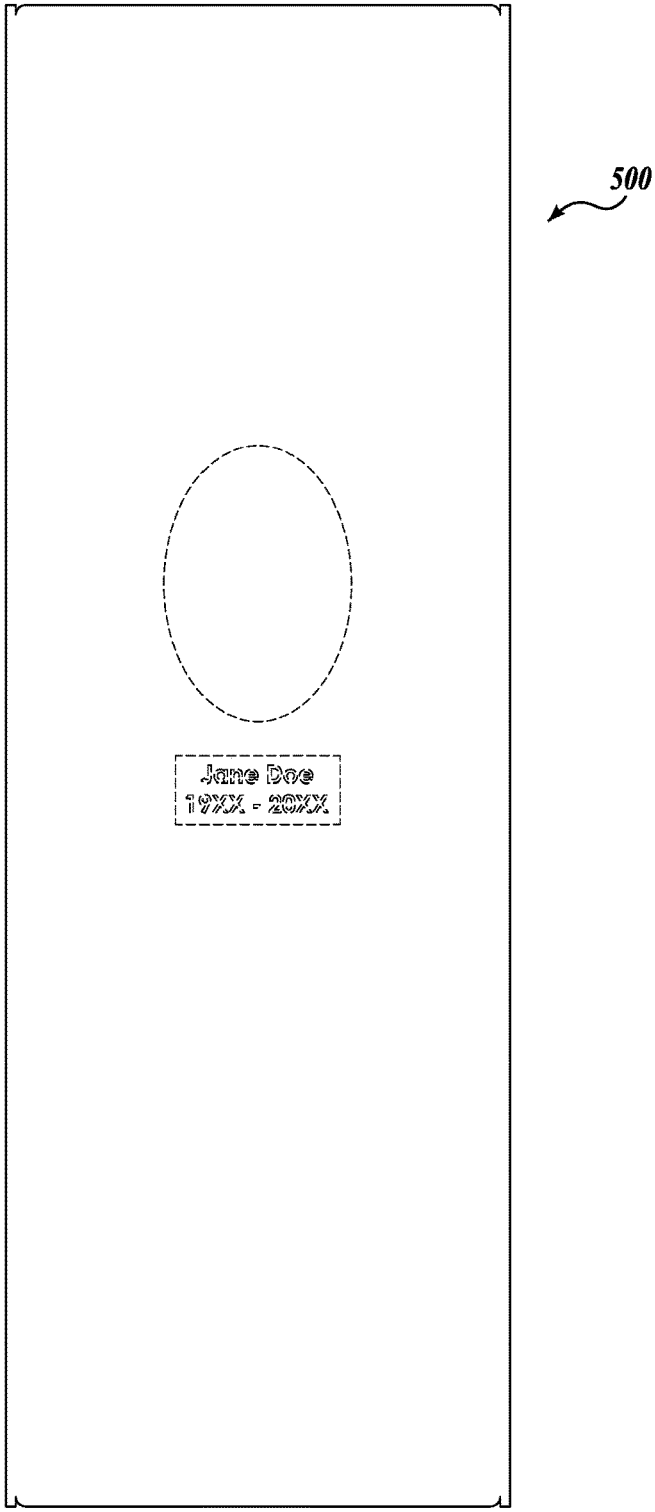
Figure 16:
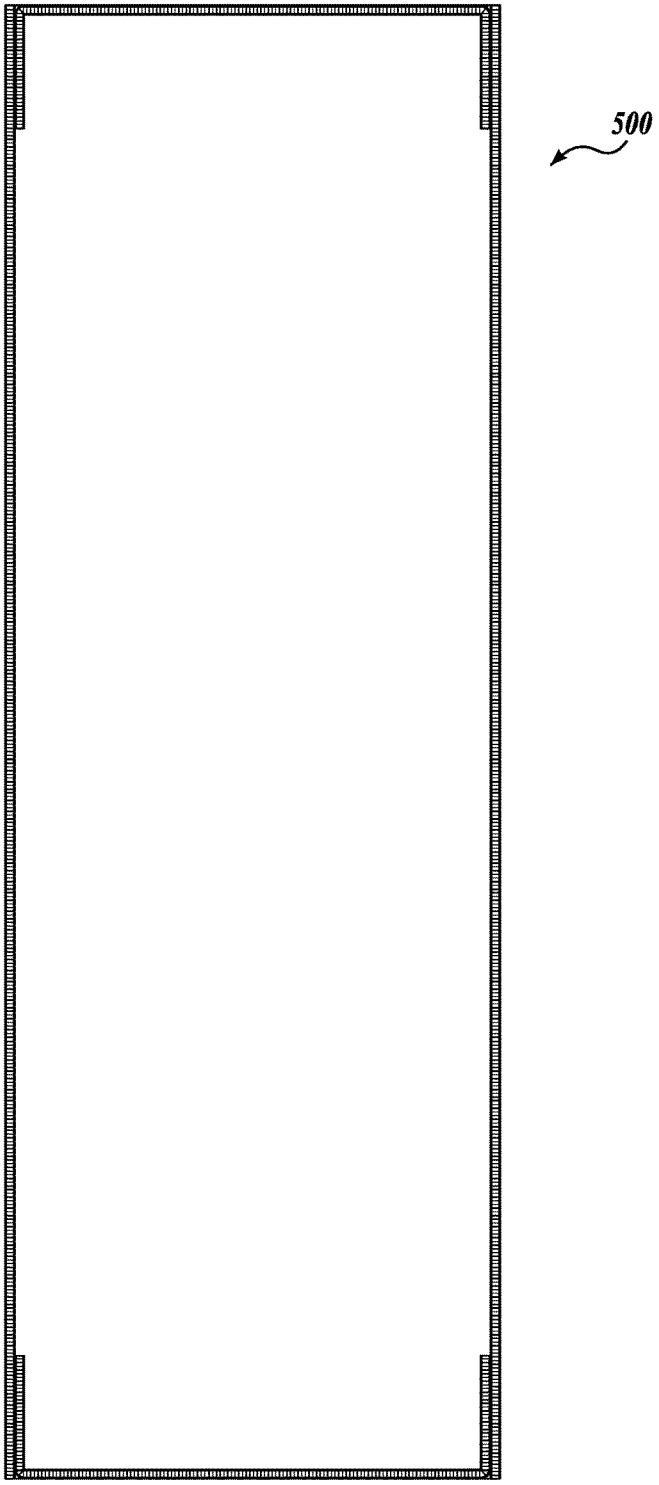
Figure 17:
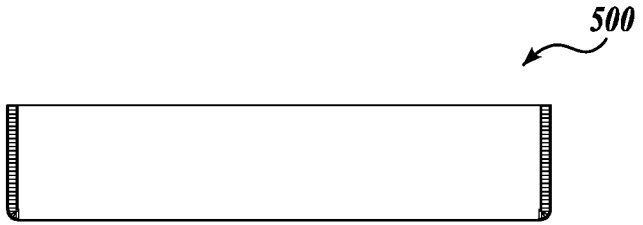
Figure 18:
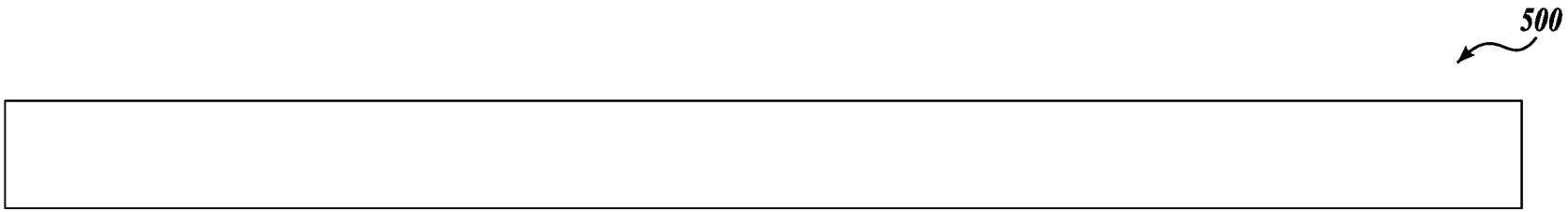
Figure 19:
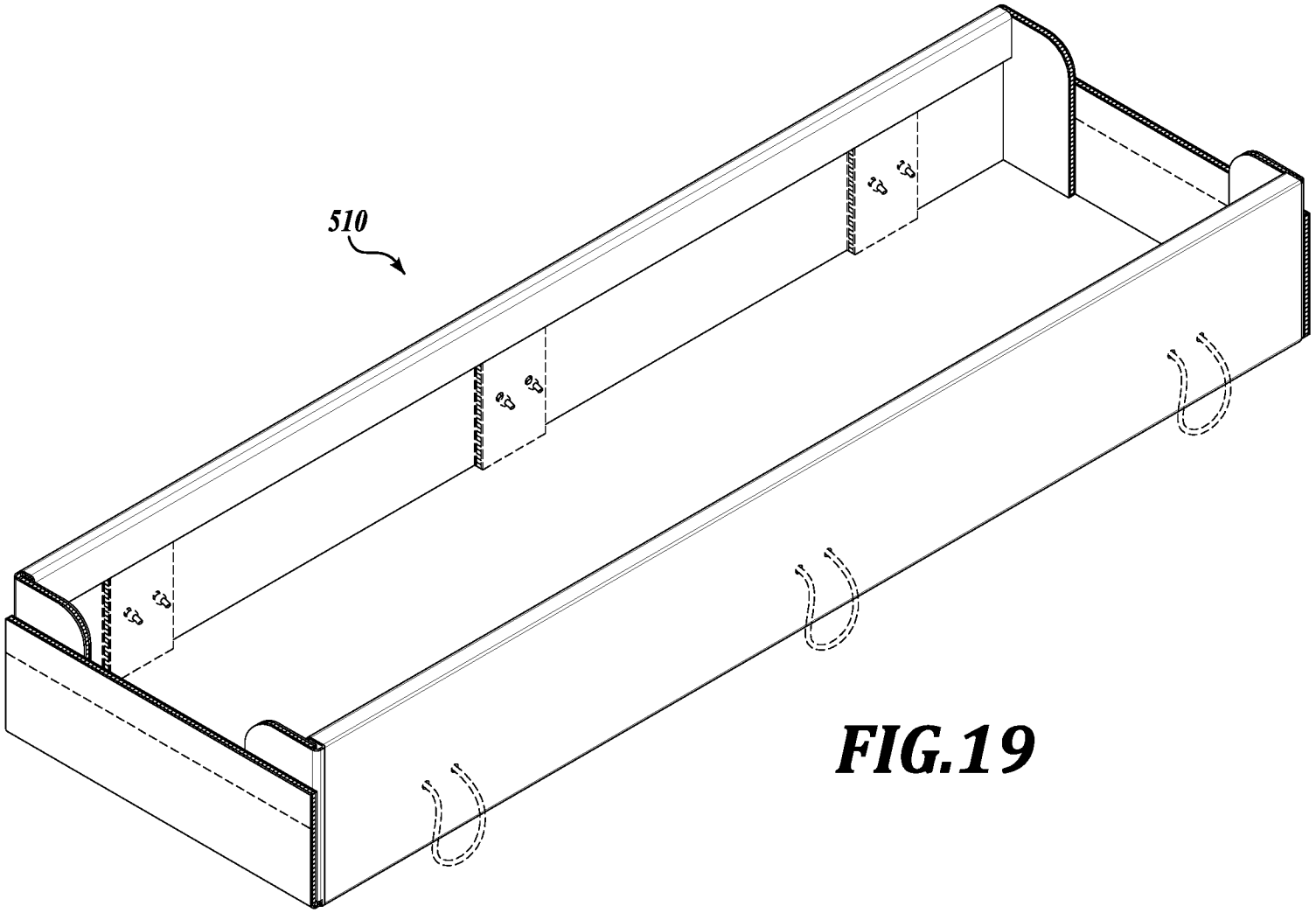
FIGS. 19 to 23 depict, respectively, a perspective view, a top view, a bottom view, an end view, and a side view of an embodiment of a bottom piece of a cardboard casket, in accordance with the embodiments disclosed herein.
Figure 20:
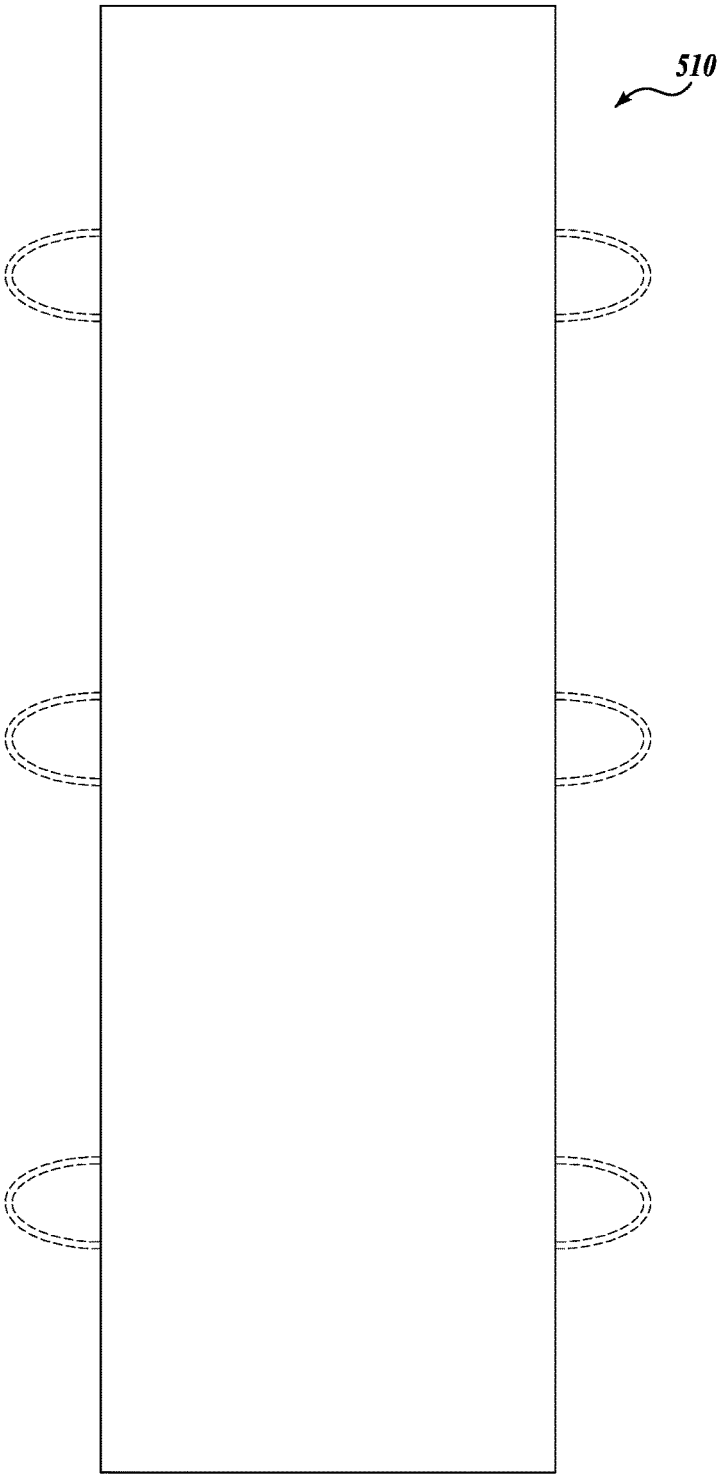
Figure 21:
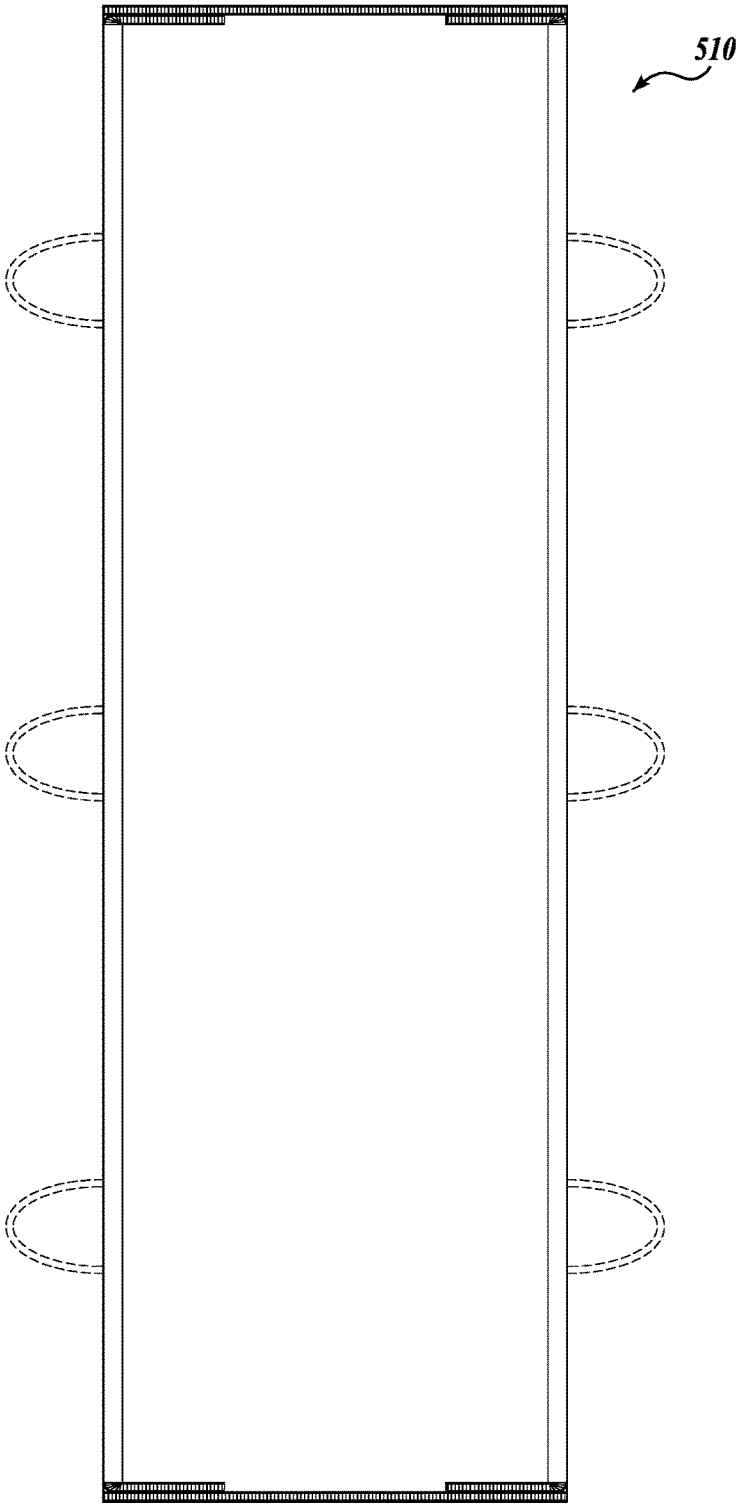
Figure 22:
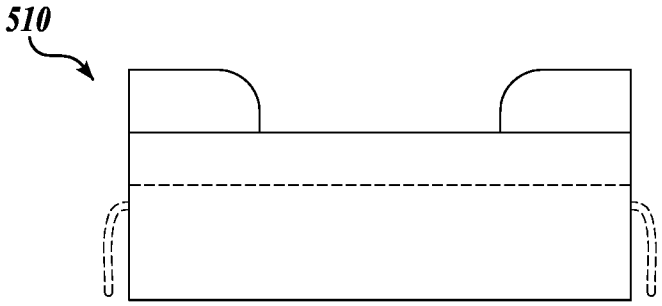
Figure 23:
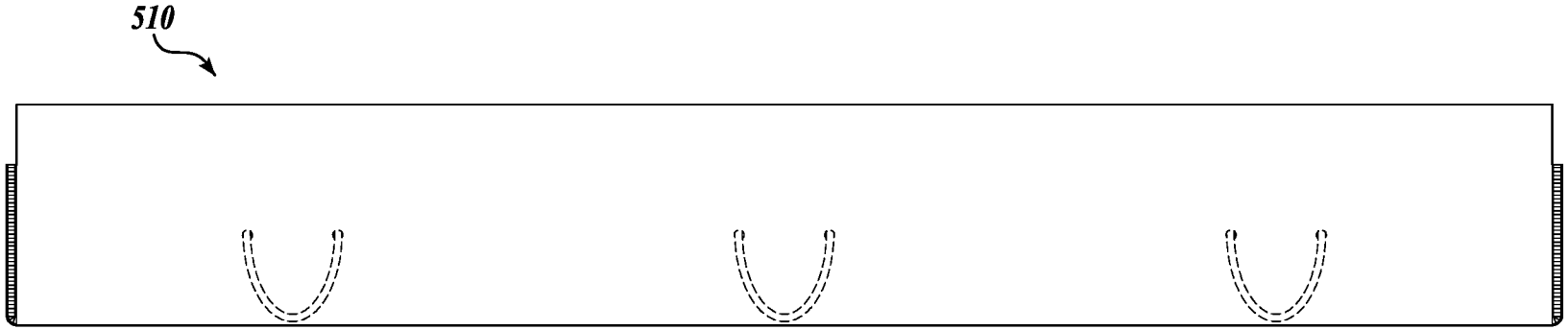

FIGS. 13A and 13B depict embodiments of panels of reinforced core cardboard that can be die pressed to form, respectively, top and bottom pieces of a cardboard casket. FIG. 13A depicts a panel 400 of reinforced core cardboard with lines representing the locations of cuts and seams that can be created to form a bottom piece 402. In some embodiments, the size of the panel 400 is a standard size of a reinforced core cardboard panel or a maximum size that a die press can accommodate. In the embodiment shown in FIG. 13A, the bottom piece 402 extends to each of the sides of panel 400. In this embodiment, end panels of the bottom piece may not be able to be as long as needed to prevent a gap between the bottom piece 402 and a top piece when the cardboard casket is assembled (e.g., the gap 318 depicted in FIG. 12A) because the die press machine cannot accommodate a longer panel, because the panel 400 is a standard size and cannot be extended, or because of some other reason.

FIG. 13B depicts a panel 410 of reinforced core cardboard with lines representing the locations of cuts and seams that can be created to form a top piece 412. In some embodiments, the size of the panel 410 is a standard size of a reinforced core cardboard panel or a maximum size that a die press can accommodate. In one embodiments, the size of the panel 410 is the same as the size of the panel 400 depicted in FIG. 13A. In the embodiment shown in FIG. 13A, the top piece 412 extends from the top to the bottom of the panel 410, but does not extend from the left side to the right side of the panel 410. In the embodiments shown in FIGS. 13A and 13B, the top piece 412 is not as wide as the bottom piece 402. In the embodiment shown in FIG. 13B, reinforcement pieces 414 and extension pieces 416 are also cut out of the portion of the panel 410 that is not taken up with the top piece 412. In this way, the portion of the panel 410 that is not taken up with the top piece 412 is not completely wasted, but is used to form the reinforcement pieces 414 and the extension pieces 416 that can be used with the bottom piece 402. In one embodiment, the reinforcement pieces 414 and the extension pieces 416 are cut by the same single die cut press that also forms the top piece 412.

FIGS. 14 to 18 depict, respectively, a perspective view, a top view, a bottom view, an end view, and a side view of an embodiment of a top piece 500 of a cardboard casket. FIGS. 19 to 23 depict, respectively, a perspective view, a top view, a bottom view, an end view, and a side view of an embodiment of a bottom piece 510 of a cardboard casket.

It should be noted that for purposes of this disclosure, terminology such as "upper," "lower," "vertical," "horizontal," "inwardly," "outwardly," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

While illustrative embodiments have been illustrated and described, it will be appreciated that various changes can be made therein without departing from the spirit and scope of the invention.

The invention claimed is:

1. A method of forming a cardboard casket, the method comprising:

forming a top piece, comprising:

providing a first reinforced core cardboard panel having a first layer, a second layer, and a reinforced core located between the first and second layers;

using a first single die cut press to cut through the first layer, the reinforced core, and the second layer of the first reinforced core cardboard panel;

using the first single die cut press to form seams in the first reinforced core cardboard panel by deforming the first layer in the seams, deforming a majority of the reinforced core in the seams, and leaving the second layer in the seam uncut; and forming a bottom piece, comprising:

providing a second reinforced core cardboard panel having a first layer, a second layer, and a reinforced core located between the first and second layers;

using a second single die cut press to cut through the first layer, the reinforced core, and the second layer of the second reinforced core cardboard panel; and using the second single die cut press to form seams in the second reinforced core cardboard panel by deforming the first layer in the seams, deforming a majority of the reinforced core in the seams, and leaving the second layer in the seam uncut.

2. The method of claim 1, further comprising placing adhesive on an outer surface of the second layer of at least one tab defined on the top piece.

3. The method of claim 1, further comprising folding along the seams of the top piece such that the adhesive on the at least one tab adheres to the first layer of a side panel of the top piece.

4. The method of claim 1, further comprising:

using the first single die cut press to cut a reinforcement piece from the first reinforced core cardboard panel;

using the first single die cut press to cut a pair of handle holes in the reinforcement piece; and using the second single die cut press to cut a pair of handle holes in a side panel of the bottom piece.

5. The method of claim 4, further comprising placing the reinforcement piece against the side panel of the bottom piece with the pair of handle holes in the reinforcement piece aligned with the pairs of handle holes in the side panel.

6. The method of claim 5, further comprising:

feeding ends of a handle through the aligned pair of handle holes in the reinforcement pieces and the pair of handle holes in the side panels; and tying a knot in each of the ends of the handle to prevent the ends of the handle from being pulled back through the pair of handle holes in the reinforcement pieces and the pair of handle holes in the side panels.

7. The method of claim 1, wherein the seams in the bottom piece include a seam between a main panel and a side panel and a pair of seams between the side panel and a ledge panel.

8. The method of claim 7, wherein forming the bottom piece further comprises:

folding the bottom piece along the seam between the main panel and the side panel to form an angle between the main panel and the side panel;

folding the bottom piece along the pair of seams between the side panel and the ledge panel such that the first layer of the side panel is substantially parallel to the first layer of the ledge panel; and adhering the first layer of the side panel to the first layer of the ledge panel.

9. The method of claim 1, wherein the seams in the bottom piece include a seam between a main panel and an end panel.

10. The method of claim 9, wherein forming the bottom piece further comprises:

folding the bottom piece along the seam between the main panel and the end panel to form an angle between the main panel and the end panel; and adhering the end panel to first and second tabs of the bottom piece.

11. The method of claim 10, further comprising adhering an extension piece to the first and second tabs of the bottom piece above the end piece.

12. The method of claim 11, further comprising using the first single die cut press to cut the extension piece from the first reinforced core cardboard panel.

13. The method of claim 1, further comprising printing, on an outer surface of the second layer of the first reinforced core cardboard panel, one or more of text, graphics, or a background image.

14. The method of claim 1, wherein an outer surface of the second layer of the bottom piece is printed before using the second single die cut press.

15. A cardboard casket, comprising:

a top piece, comprising:

a main panel;

first and second end panels and first and second seams defined between the first and second end panels and the main panel;

first and second side panels and third and fourth seams defined between the first and second side panels and the main panel;

a bottom piece, comprising:

a main panel;

first and second end panels and first and second seams defined between the first and second end panels and the main panel;

first and second side panels and third and fourth seams defined between the first and second side panels and the main panel; and first and second ledge panels and at least a fifth seam defined between the first ledge panel and the first side panel and at least a sixth seam defined between the second ledge panel and the second side panel;

wherein the top and bottom pieces are made from first and second reinforced core cardboard panels each having a first layer, a second layer, and a reinforced core located between the first and second layers, and wherein the seams in the top and bottom pieces are defined by a deformed first layer and a deformed majority of the reinforced core, with the second layer remaining uncut.

16. The cardboard casket of claim 15, wherein the reinforced core of each of the first and second reinforced core cardboard panels includes cells of a geometric shape.

17. The cardboard casket of claim 15, the top piece further comprises:

first and second tabs and seventh and eighth seams defined between the first and second tabs and the first end panel;

third and fourth tabs and ninth and tenth seams defined between the third and fourth tabs and the second end panel; and adhesive on an outer surface of the second layer of each tab.

18. The cardboard casket of claim 15, the bottom piece further comprises:

first and second tabs and seventh and eighth seams defined between the first and second tabs and the first side panel;

third and fourth tabs and ninth and tenth seams defined between the third and fourth tabs and the second side panel; and adhesive on an outer surface of the second layer of each tab.

19. The cardboard casket of claim 15, further comprising adhesive on an outer surface of the first layer of each ledge panel.

* * * * *